US007903383B2

(12) United States Patent
Fukano et al.

(10) Patent No.: US 7,903,383 B2
(45) Date of Patent: Mar. 8, 2011

(54) SOLENOID VALVE DRIVING CIRCUIT AND SOLENOID VALVE

(75) Inventors: Yoshihiro Fukano, Moriya (JP); Masami Yoshida, Ryugasaki (JP); Yoshitada Doi, Koshigaya (JP); Shigeharu Oide, Adachi-ku (JP)

(73) Assignee: SMC Kabushiki Kaisha, Tokyo (JP)

( * ) Notice: Subject to any disclaimer, the term of this patent is extended or adjusted under 35 U.S.C. 154(b) by 455 days.

(21) Appl. No.: 12/140,747

(22) Filed: Jun. 17, 2008

(65) Prior Publication Data

US 2009/0015979 A1 Jan. 15, 2009

(30) Foreign Application Priority Data

Jul. 9, 2007 (JP) ..... 2007-179936

(51) Int. Cl.
*H01H 47/00* (2006.01)

(52) U.S. Cl. ..... 361/152

(58) Field of Classification Search ..... 361/152
See application file for complete search history.

(56) References Cited

U.S. PATENT DOCUMENTS

| | | | | |
|---|---|---|---|---|
| 4,729,056 | A * | 3/1988 | Edwards et al. | 361/153 |
| 6,031,707 | A * | 2/2000 | Meyer | 361/153 |
| 6,262,874 | B1 | 7/2001 | Stoll et al. | |
| 6,473,286 | B1 | 10/2002 | Itabashi et al. | |
| 6,721,158 | B2 | 4/2004 | Heinke | |
| 6,785,112 | B2 * | 8/2004 | Reischl et al. | 361/154 |
| 6,820,945 | B2 | 11/2004 | Woerner et al. | |
| 7,216,939 | B2 * | 5/2007 | Obai | 303/11 |
| 2006/0221534 | A1 | 10/2006 | Oide | |

FOREIGN PATENT DOCUMENTS

| | | | |
|---|---|---|---|
| DE | 297 15 925 | U1 | 12/1997 |
| DE | 100 38 654 | A1 | 3/2001 |
| DE | 199 63 154 | A1 | 6/2001 |
| DE | 10 2006 014 276 | A1 | 10/2006 |
| EP | 1 203 389 | B1 | 5/2002 |
| JP | 62-49085 | | 3/1987 |
| JP | 63-140188 | | 6/1988 |
| JP | 3-177668 | | 8/1991 |
| JP | 7-332530 | | 12/1995 |
| JP | 2001-221121 | | 8/2001 |
| JP | 2002-221280 | | 8/2002 |
| JP | 2004-514581 | | 5/2004 |
| JP | 3777265 | | 3/2006 |
| JP | 2006-308082 | | 11/2006 |

OTHER PUBLICATIONS

U.S. Appl. No. 12/140,578, filed Jun. 17, 2008, Fukano, et al.

* cited by examiner

*Primary Examiner* — Stephen W Jackson
(74) *Attorney, Agent, or Firm* — Oblon, Spivak, McClelland, Maier & Neustadt, L.L.P.

(57) ABSTRACT

A current detection circuit generates a pulse signal Sd based on a voltage Vd corresponding to a current I flowing through a solenoid coil, and feeds the pulse signal Sd back to a PWM circuit of a switch controller. The PWM circuit generates a pulse signal Sr having a predetermined duty ratio, based on a comparison between the fed back pulse signal Sd and a voltage value corresponding to a first current value or a second current value, and supplies the pulse signal Sr to a pulse supplying unit. The pulse supplying unit supplies the pulse signal Sr as a first pulse signal S1 and/or a second pulse signal S2 to a gate terminal G of a MOSFET.

18 Claims, 6 Drawing Sheets

SWITCH ON
SWITCH OFF
Vo
POWER SOURCE VOLTAGE

OUTPUT OF SINGLE PULSE GENERATING CIRCUIT

T7
OUTPUT OF PWM CIRCUIT
T5

INPUT TO GATE TERMINAL G

Vo
APPLIED VOLTAGE OF SOLENOID COIL

I1
I2
CURRENT FLOWING THROUGH SOLENOID COIL
T0
T11
T10
T3
T2
T4
T1
TIME

SWITCH ON
SWITCH OFF
Vo'
POWER SOURCE VOLTAGE

OUTPUT OF SINGLE PULSE GENERATING CIRCUIT

T6
T7
OUTPUT OF PWM CIRCUIT
T5
T5

INPUT TO GATE TERMINAL G

Vo'
APPLIED VOLTAGE OF SOLENOID COIL

I1
I2
CURRENT FLOWING THROUGH SOLENOID COIL
T0
T8
T2'
T2
T1
T9
T3'
T4'
TIME

10D

SOLENOID VALVE DRIVING CIRCUIT AND SOLENOID VALVE

BACKGROUND OF THE INVENTION

1. Field of the Invention

The present invention relates to a solenoid valve driving circuit in which, after a first voltage is impressed on the solenoid coil of a solenoid valve for driving the solenoid valve, a second voltage is impressed on the solenoid coil and the driven state of the solenoid valve is maintained, as well as to a solenoid valve having such a solenoid valve driving circuit.

2. Description of the Related Art

Conventionally, it has been widely practiced to arrange a solenoid valve within a fluid passage, and by impressing a voltage on a solenoid coil of the solenoid valve from a solenoid valve driving circuit, the solenoid valve is energized to open and close the fluid passage. In this case, after the solenoid valve is driven by impressing a first voltage on the solenoid coil of the solenoid valve from the solenoid valve driving circuit, the driven state of the solenoid valve is maintained by impressing a second voltage on the solenoid coil from the solenoid valve driving circuit.

Recently, it has been desired that the driven state be maintained with low power consumption. In Japanese Patent No. 3777265 and Japanese Laid-Open Patent Publication No. 2006-308082, it has been proposed that, within a time period during which the driven state is maintained, and as a result of controlling conduction between the power source and the solenoid coil by means of a switch, energization and deenergization of the solenoid coil is carried out repeatedly, so that the driven state of the solenoid valve can be maintained with a lower level of power consumption.

Incidentally, the current flowing through the solenoid coil tends to vary over time as a result of various factors, such as changes in electrical resistance in the solenoid coil induced by temperature changes of the solenoid coil, timewise changes of the power source voltage (first voltage and second voltage) impressed on the solenoid coil from the DC power source through the solenoid valve driving circuit, and due to vibrations or shocks and the like, which are imparted to the solenoid valve from the exterior thereof. Owing thereto, within the time period during which the driven state of the solenoid valve is maintained, so as to prevent the above-mentioned various factors from occurring and causing stoppage of the solenoid valve, a current, which takes into consideration the aforementioned various factors, is superimposed on the minimal required current for maintaining the driven state. Accordingly, even when the above-mentioned various factors do not occur, the current taken in consideration of these factors still flows through the solenoid coil, and hence, electrical power savings of the solenoid valve driving circuit and the solenoid valve cannot be promoted.

Further, as a result of the current that flows through the solenoid coil being large, when driving of the solenoid valve is halted after maintaining the driven state, the solenoid valve cannot be stopped in a short time period.

Moreover, in the case that a plurality of DC power sources, having different power source voltages, are prepared and utilized on the side of users of the solenoid valves, on the manufacturer's side, even if there are solenoid valve driving circuits and solenoid valves having roughly the same capability with respect to opening/closing the same fluid passage, because it is necessary to separately manufacture the solenoid valve driving circuits and solenoid valves corresponding to differences of the various power source voltages, manufacturing costs tend to rise.

Still further, because the electrical power consumption of a solenoid valve driving circuit and a solenoid valve corresponding to the case of a relatively high power source voltage (e.g., 24V) is larger than the electrical power consumption of a solenoid valve driving circuit and a solenoid valve corresponding to the case of a relatively low power source voltage (e.g., 12V), on the side of a user equipped with a DC power source having a relatively high power source voltage, electrical power savings of the solenoid valve driving circuit and the solenoid valve cannot be achieved.

SUMMARY OF THE INVENTION

The present invention has the object of providing a solenoid valve driving circuit and a solenoid valve, which are capable of realizing, in one sweep, a reduction in electrical power consumption, a rapidly responsive drive control for the solenoid valve, and a reduction in costs.

In accordance with the present invention, a solenoid valve driving circuit is provided, in which, after a first voltage is impressed on the solenoid coil of a solenoid valve for driving the solenoid valve, a second voltage is impressed on the solenoid coil and a driven state of the solenoid valve is maintained, the solenoid valve driving circuit being electrically connected, respectively, to a direct current power source and to the solenoid coil, and further including a switch controller, a switch, and a current detector, wherein the current detector detects a current flowing through the solenoid coil, and outputs a detection result, as a current detection value, to the switch controller, wherein the switch controller generates a first pulse signal based on a comparison between a predetermined activation current value and the current detection value, and a second pulse signal based on a comparison between a predetermined holding current value and the current detection value, and supplies the first pulse signal and the second pulse signal to the switch, and wherein the switch applies a power source voltage of the direct current power source as the first voltage to the solenoid coil during a time period when the first pulse signal is supplied thereto, and applies the power source voltage as the second voltage to the solenoid coil during a time period when the second pulse signal is supplied thereto.

Herein, within the time period that the solenoid valve is driven, the necessary excitation force (activation force) for driving a movable core (plunger) that makes up the solenoid valve and for driving a valve plug installed onto the end of the plunger, and the necessary excitation force (holding force) needed to maintain (hold) the plunger and the valve plug at a predetermined position during a time period in which the driven state of the solenoid valve is maintained, are values resulting from multiplying the number of windings (turns) of the solenoid coil and the current that flows through the solenoid coil (respective excitation forces=number of windings× current). Therefore, assuming that the activation force needed to drive the solenoid valve, the minimum necessary holding force for maintaining the driven state, and the number of windings, respectively, are known ahead of time, an optimal current (activation current value) corresponding to the activation force, as well as an optimal current value (holding current) corresponding to the holding force, can easily be calculated.

Further, at the time of supplying the first pulse signal or the second pulse signal to the switch from the switch controller, the power source voltage is applied to the solenoid coil as a first voltage or a second voltage, whereby the supply of electrical power to the solenoid coil is carried out from the DC power source, and thus, the current flowing through the solenoid coil increases. On the other hand, at times when supply of the first pulse signal or the second pulse signal to the switch from the switch controller is halted, the supply of electrical power is stopped, and thus, the current flowing through the solenoid coil is reduced. Accordingly, by timewise controlling the supply of the first pulse signal and the second pulse signal with respect to the switch, the current flowing through the solenoid coil can be maintained at desired current values (i.e., an activation current value optimal for the activation force, and a holding current value optimal for the holding force).

In the present invention, the current detector detects the current flowing through the solenoid coil, and the current detection value is fed back to the switch controller. In the switch controller, the first pulse signal is generated based on a comparison between the activation current value, as an optimal current corresponding to the activation force, and the fed back current detection value, whereas the second pulse signal is generated based on a comparison between the holding current value, as an optimal current corresponding to the holding force, and the fed back current detection value. The switch applies the first voltage to the solenoid coil only at times corresponding to a pulse width of the first pulse signal, or applies the second voltage to the solenoid coil only at times corresponding to a pulse width of the second pulse signal.

That is, during the time period when the solenoid valve is driven, the switch controller generates the first pulse signal so that the current detection value becomes the activation current value corresponding to the activation force, and supplies the first pulse signal to the switch, whereby the switch, based on the pulse width of the first pulse signal, controls the application time of the first voltage to the solenoid coil. Owing thereto, the current flowing through the solenoid coil is maintained at the activation current value corresponding to the activation force, and the activation force induced by such a current is impressed to energize the plunger and the valve plug.

More specifically, on the side of the user of the solenoid valve, in the case that a DC power source has been prepared beforehand having a relatively high power source voltage (e.g., 24V), and a solenoid valve that uses a relatively low power source voltage (e.g., 12V) is applied with respect to such a DC power source, the activation current value is set in the switch controller at or below a rated value (rated current) of the current flowing through the solenoid coil. Then, if the pulse width of the first pulse signal is adjusted such that the current detection value becomes the thus set activation current value, the current flowing through the solenoid coil during the time period that the solenoid valve is driven is maintained at the activation current value, and thus, even for a user for whom a DC power source having a relatively high power source voltage has been prepared, a power savings can be achieved for the solenoid valve driving circuit and the solenoid valve. In this case, since the relatively high power source voltage is applied as the first voltage to the solenoid coil, it is possible for the solenoid valve to be driven in a shorter time.

As described above, by adjusting the pulse width of the first pulse signal in the switch controller, the current that flows through the solenoid coil can be maintained at the activation current value, which is at or below the rated current. Therefore, on the side of the manufacturer, without concern to any difference in the power source voltage supplied to the solenoid coil from the DC power source provided on the user's side, the solenoid valve driving circuit and the solenoid can be made commonly usable in accordance with a relatively low power source voltage, wherein by providing such a commonly usable solenoid valve driving circuit and solenoid valve to the user, costs can be reduced.

Accordingly, with the present invention, by generating the first pulse signal based on a comparison between the current detection value that is fed back to the switch controller from the current detector and the activation current value during a time period in which the solenoid valve is driven, power savings of the solenoid valve driving circuit and the solenoid valve, common usage and cost reduction, and a rapidly-responsive drive control for the solenoid valve, are all capable of being realized.

On the other hand, during a time period in which the driven state of the solenoid valve is maintained, the switch controller generates a second pulse signal so that the current detection value becomes the holding current value corresponding to the holding force, whereupon the second pulse signal is supplied to the switch, and the switch thereby controls, based on the pulse width of the second pulse signal, the application time at which the second voltage is applied to the solenoid coil. Owing thereto, the current flowing through the solenoid coil is maintained at the holding current value corresponding to the holding force, and the holding force induced by the current is impressed to energize the plunger and the valve plug.

Accordingly, with the present invention, by generating the second pulse signal based on a comparison between the current detection value that is fed back to the switch controller from the current detector during a time period in which the driven state of the solenoid valve is maintained and the holding current value, the driven state of the solenoid valve can be maintained with smaller power consumption, and further, the solenoid valve can be stopped in a short time.

Further, by feeding back the current detection value to the switch controller, even if the current tends to vary over time due to changes in electrical resistance inside the solenoid coil or due to changes in the power source voltage as a result of temperature changes in the solenoid coil, the second pulse signal is generated responsive to such changes, whereby a solenoid valve driving circuit and a solenoid valve, which are capable of responding to changes in the use environment, such as changes in electrical resistance and power source voltage or the like, can be realized.

In this manner, with the present invention, a reduction in electrical power consumption of the solenoid valve driving circuit and the solenoid valve, rapidly responsive drive control for the solenoid valve, and a reduction in costs for the solenoid valve driving circuit and the solenoid valve, can all be realized together in one sweep.

Herein, the switch controller preferably includes:

a single pulse generating circuit for generating a single pulse;

a short pulse generating circuit, which, during a time period in which the solenoid valve is driven, generates a first short pulse having a pulse width shorter than a pulse width of the single pulse based on a comparison between the activation current value and the current detection value, whilst, during a time period in which a driven state of the solenoid valve is maintained, generates a second short pulse having a pulse width shorter than the pulse width of the first short pulse based on a comparison between the holding current value and the current detection value; and a pulse supplying unit, which, during the time period in which the solenoid valve is driven, supplies the first short pulse to the switch as the first pulse signal after the single pulse has been supplied to the switch as the first pulse signal, whilst, during the time period in which the driven state of the solenoid valve is maintained, supplies the second short pulse to the switch as the second pulse signal.

In this case, in the time period during which the solenoid valve is driven, after the power source voltage has been impressed as the first voltage on the solenoid coil only during a time corresponding to the pulse width of the single pulse, the switch then impresses the first voltage on the solenoid coil only during a time corresponding to the pulse width of the first short pulse. As a result, in the time period during which the solenoid valve is driven, after the current flowing through the solenoid coil has risen up to the activation current value within a time corresponding to the pulse width of the single pulse, the activation current value is maintained by a switching operation of the switch based on the first short pulse. Owing thereto, the solenoid valve driving circuit and the solenoid valve can be made commonly usable, and costs can be reduced easily. In particular, in the case that a DC power source having a relatively high power source voltage is electrically connected to the solenoid coil through the solenoid valve driving circuit and the solenoid valve is driven thereby, the solenoid valve is capable of being driven in a short time. Further, by maintaining the current flowing through the solenoid coil at the activation current value, unintended or mistaken operations of the solenoid valve driving circuit and the solenoid valve caused by the input of excessive voltage (surge energy) can be reliably prevented.

On the other hand, during a time period at which the driven state of the solenoid valve is maintained, by supplying the second short pulse as the second pulse signal to the switch, the driven state of the solenoid valve can be maintained with lower power consumption, and further, the solenoid valve can be stopped in a short time.

Herein, in place of the aforementioned structure, the switch controller may preferably include:

a single pulse generating circuit for generating a single pulse;

a repeating pulse generating circuit, which, during a time period in which the solenoid valve is driven, generates a first repeating pulse having a pulse width shorter than a pulse width of the single pulse based on a comparison between the activation current value and the current detection value, whilst, during a time period in which a driven state of the solenoid valve is maintained, generates a second repeating pulse having a pulse width shorter than the pulse width of the first repeating pulse based on a comparison between the holding current value and the current detection value; and a pulse supplying unit, which, during the time period in which the solenoid valve is driven, supplies the first repeating pulse to the switch as the first pulse signal after the single pulse has been supplied to the switch as the first pulse signal, whilst, during the time period in which the driven state of the solenoid valve is maintained, supplies the second repeating pulse to the switch as the second pulse signal.

In this case, in the time period during which the solenoid valve is driven, after the power source voltage has been impressed as the first voltage on the solenoid coil only during a time corresponding to the pulse width of the single pulse, the switch then impresses the first voltage on the solenoid coil only during a time corresponding to the pulse width of the first repeating pulse. As a result, in the time period during which the solenoid valve is driven, after the current flowing through the solenoid coil has risen up to the activation current value within a time corresponding to the pulse width of the single pulse, the activation current value is maintained by a switching operation of the switch based on the first repeating pulse. In this case as well, the solenoid valve driving circuit and the solenoid valve can be made commonly usable, and costs can be reduced easily, and moreover, in the case that a DC power source having a relatively high power source voltage is electrically connected to the solenoid coil through the solenoid valve driving circuit and the solenoid valve is driven thereby, the solenoid valve is capable of being driven in a short time. Further, by maintaining the current flowing through the solenoid coil at the activation current value, unintended or mistaken operations of the solenoid valve driving circuit and the solenoid valve caused by the input of excessive voltage (surge energy) can be reliably prevented.

On the other hand, during a time period at which the driven state of the solenoid valve is maintained, by supplying the second repeating pulse as the second pulse signal to the switch, the driven state of the solenoid valve can be maintained with lower power consumption, and further, the solenoid valve can be stopped in a short time.

Accordingly, by providing each of the above-described structures for the switch controller, common usage and cost reduction of the solenoid valve driving circuit and the solenoid valve, driving of the solenoid valve in a short time, power savings of the solenoid valve driving circuit and the solenoid valve, and the ability to stop the solenoid valve in a short time, can easily be realized.

With the above-described invention, during a time period in which the solenoid valve is driven, supply of the first pulse signal is timewise controlled based on a comparison between the activation current value and the current detection value, whilst, during a time period in which the solenoid valve is maintained in the driven state, supply of the second pulse signal is timewise controlled based on a comparison between the holding current value and the current detection value.

With such a timewise control based on the current detection value, the control can be carried out only during the time period in which the solenoid valve is driven, or alternatively, only during the time period in which the solenoid valve is maintained in the driven state.

More specifically, in order to carry out a timewise control based on the current detection value only during the time period in which the solenoid valve is driven, the structure of the solenoid valve driving circuit is as follows.

Namely, a solenoid valve driving circuit is provided in which, after a first voltage is impressed on a solenoid coil of a solenoid valve for driving the solenoid valve, a second voltage is impressed on the solenoid coil and a driven state of the solenoid valve is maintained, the solenoid valve driving circuit being electrically connected, respectively, to a direct current power source and to the solenoid coil, and further comprising a switch controller, a switch, and a current detector, wherein the current detector detects a current flowing through the solenoid coil, and outputs a detection result, as a current detection value, to the switch controller, wherein the switch controller generates a first pulse signal based on a comparison between a predetermined activation current value and the current detection value, and a predetermined second pulse signal, and supplies the first pulse signal and the second pulse signal to the switch, and wherein the switch applies a power source voltage of the direct current power source as the first voltage to the solenoid coil during a time period when the first pulse signal is supplied thereto, and applies the power source voltage as the second voltage to the solenoid coil during a time period when the second pulse signal is supplied thereto.

In this case, preferably, the switch controller includes:

a single pulse generating circuit for generating a single pulse;

a short pulse generating circuit, which, during a time period in which the solenoid valve is driven, generates a first short pulse having a pulse width shorter than a pulse width of the single pulse based on a comparison between the activation current value and the current detection value, whilst, during a time period in which a driven state of the solenoid valve is maintained, generates a predetermined second short pulse having a pulse width shorter than the pulse width of the first short pulse; and a pulse supplying unit, which, during the time period in which the solenoid valve is driven, supplies the first short pulse to the switch as the first pulse signal after the single pulse has been supplied to the switch as the first pulse signal, whilst, during the time period in which the driven state of the solenoid valve is maintained, supplies the second short pulse to the switch as the second pulse signal.

Further, in place of the aforementioned structure, the switch controller may preferably include:

a single pulse generating circuit for generating a single pulse;

a repeating pulse generating circuit, which, during a time period in which the solenoid valve is driven, generates a first repeating pulse having a pulse width shorter than a pulse width of the single pulse based on a comparison between the activation current value and the current detection value, whilst, during a time period in which a driven state of the solenoid valve is maintained, generates a predetermined second repeating pulse having a pulse width shorter than the pulse width of the first repeating pulse; and a pulse supplying unit, which, during the time period in which the solenoid valve is driven, supplies the first repeating pulse to the switch as the first pulse signal after the single pulse has been supplied to the switch as the first pulse signal, whilst, during the time period in which the driven state of the solenoid valve is maintained, supplies the second repeating pulse to the switch as the second pulse signal.

In this manner, in the case that a timewise control is carried out based on the current detection value only during a time period in which the solenoid valve is driven, the aforementioned advantageous effects can easily be obtained with respect to the timewise control.

On the other hand, in order to carry out a timewise control based on the current detection value only during the time period in which the solenoid valve is maintained in the driven state, the structure of the solenoid valve driving circuit is as follows.

Namely, a solenoid valve driving circuit is provided in which, after a first voltage is impressed on a solenoid coil of a solenoid valve for driving the solenoid valve, a second voltage is impressed on the solenoid coil and a driven state of the solenoid valve is maintained, the solenoid valve driving circuit being electrically connected, respectively, to a direct current power source and to the solenoid coil, and further including a switch controller, a switch, and a current detector, wherein the current detector detects a current flowing through the solenoid coil, and outputs a detection result, as a current detection value, to the switch controller, wherein the switch controller generates a predetermined first pulse signal, and a second pulse signal based on a comparison between a predetermined holding current value and the current detection value, and supplies the first pulse signal and the second pulse signal to the switch, and wherein the switch applies a power source voltage of the direct current power source as the first voltage to the solenoid coil during a time period when the first pulse signal is supplied thereto, and applies the power source voltage as the second voltage to the solenoid coil during a time period when the second pulse signal is supplied thereto.

In this case, preferably, the switch controller includes:

a single pulse generating circuit for generating a single pulse;

a short pulse generating circuit, which generates a short pulse having a pulse width shorter than a pulse width of the single pulse based on a comparison between the holding current value and the current detection value; and a pulse supplying unit, which, during the time period in which the solenoid valve is driven, supplies the single pulse to the switch as the first pulse signal, whilst, during the time period in which the driven state of the solenoid valve is maintained, supplies the short pulse to the switch as the second pulse signal.

Further, in place of the aforementioned structure, the switch controller may preferably include:

a single pulse generating circuit for generating a single pulse;

a repeating pulse generating circuit, which generates a repeating pulse having a pulse width shorter than a pulse width of the single pulse based on a comparison between the holding current value and the current detection value; and a pulse supplying unit, which, during the time period in which the solenoid valve is driven, supplies the single pulse to the switch as the first pulse signal, whilst, during the time period in which the driven state of the solenoid valve is maintained, supplies the repeating pulse to the switch as the second pulse signal.

In this manner, in the case that a timewise control is carried out based on the current detection value only during a time period in which the driven state of the solenoid valve is maintained, the aforementioned advantageous effects can easily be obtained with respect to the timewise control.

Further, in each of the foregoing inventions, preferably, the switch controller adjusts the pulse width of the second pulse signal based on a vibration detection value from a vibration detector, which detects vibration of the solenoid valve.

When the holding force is reduced for the purpose of saving power, it may be envisaged that vibrations of the solenoid valve could be caused which might lead to stoppage of the solenoid valve. However, by providing the switch controller with the above-noted structure, even if the current flowing through the solenoid coil varies over time due to vibrations, by adjusting the pulse width responsive to such variations, a solenoid valve driving circuit and a solenoid valve, which are capable of responding to vibration-induced changes, can be realized.

Specifically, in the case that there are concerns over the solenoid valve coming into a stopped condition due to vibrations inside the solenoid valve caused by vibrations or shocks and the like, which are imparted to the solenoid valve from the exterior during a time period in which the driven state of the solenoid valve is maintained, by lengthening the pulse width and increasing the current (the holding current value) that flows through the solenoid coil, the holding force on the plunger and the valve plug in the solenoid valve is made to increase, whereby the solenoid valve coming into a stopped state can reliably be prevented.

In this manner, with the present invention, since the pulse width can be set longer to increase the current (holding current value) only in cases where a high holding force is needed, power savings of the solenoid valve driving circuit and the solenoid valve can be carried out with good efficiency.

Moreover, preferably, the solenoid valve driving circuit further includes:

an energization time calculator for calculating an energization time of the solenoid coil inside of a one-time operating period of the solenoid valve based on the current detection value;

an energization time memory for storing the energization time; and an energization time determining unit for calculating a total energization time of the solenoid coil from each of respective energization times stored in the energization time memory, and determining whether or not the total energization time is longer than a predetermined first energization time, wherein the energization time determining unit outputs a pulse width change signal to the switch controller instructing that the pulse width of the first pulse signal be changed, when it is determined that the total energization time is longer than the first energization time, and wherein the switch controller lengthens the pulse width of the first pulse signal based on the pulse width change signal.

Owing thereto, even in cases where the driving performance of the solenoid valve is decreased through use of the solenoid valve over a prolonged period, by setting the pulse width of the first pulse signal to be longer at times when the total energization time of the solenoid valve becomes longer than the first energization time, since the current (activation current value) flowing through the solenoid coil becomes larger, and the activation force can be increased, driving control of the solenoid valve can be carried out efficiently.

In this case, preferably, the energization time determining unit may externally output a usage limit notification signal notifying that the solenoid valve has reached a usage limit, when it is determined that the total energization time is longer than a second energization time, which is set to be longer than the first energization time.

Owing thereto, it becomes possible to quickly exchange the solenoid valve whenever the usage limit thereof is reached, so that reliability with respect to the usage limit (life) of the solenoid valve is improved.

Further, in place of the above-noted structure, the solenoid valve driving circuit preferably further includes:

a solenoid valve operation detector for detecting that the solenoid valve is under operation based on the current detection value;

a detection result memory for storing a detection result of the solenoid valve operation detector; and an accumulated number of operation times determining unit for calculating an accumulated number of operation times of the solenoid valve from each of respective detection results stored in the detection result memory, and determining whether or not the accumulated number of operation times exceeds a predetermined first number of operation times, wherein the accumulated number of operation times determining unit outputs a pulse width change signal to the switch controller instructing that the pulse width of the first pulse signal be changed, when it is determined that the accumulated number of operation times exceeds the first number of operation times, and wherein the switch controller lengthens the pulse width of the first pulse signal based on the pulse width change signal.

If the pulse width of the first pulse signal is made longer at times when the accumulated number of operation times of the solenoid valve exceeds the first number of operation times, since the current (activation current value) flowing through the solenoid coil becomes larger, and the activation force can be increased, driving control of the solenoid valve can be carried out efficiently.

In this case, it is preferable for the accumulated number of operation times determining unit to externally output a usage limit notification signal notifying that the solenoid valve has reached a usage limit, when it is determined that the accumulated number of operation times exceeds a second number of operation times, which is set to be greater than the first number of operation times.

Owing thereto, it becomes possible to quickly exchange the solenoid valve whenever the usage limit thereof is reached, so that reliability with respect to the usage limit (life) of the solenoid valve is improved.

Further, the solenoid valve driving circuit further includes:

a current detection value monitoring unit for monitoring a decrease in the current detection value during a time period in which the solenoid valve is driven, wherein the current detection value monitoring unit externally outputs a time delay notification signal for notifying that a time delay was generated in a time period from a drive start time of the solenoid valve to a time at which the current detection value decreases, when it is determined that the time period is longer than a predetermined set time period.

Owing thereto, it becomes possible to quickly exchange a solenoid valve for which the time required for the current detection value to decrease has become longer and thus the driving performance thereof has been degraded. That is, by providing the solenoid valve driving circuit having the aforementioned structure, detection of the usage limit (life) of the solenoid valve can be carried out efficiently, based on the responsiveness of the solenoid valve during the time period in which the solenoid valve is driven.

Further, preferably, the solenoid valve driving circuit further includes a light-emitting diode capable of emitting light when the current flows through the solenoid coil, wherein a series circuit made up of the light-emitting diode and the switch controller, and the solenoid coil, are electrically connected in parallel with respect to the direct current power source.

Although, conventionally, a series circuit made up of a light-emitting diode and a current limiting resistor for causing light to be emitted from the light-emitting diode have been connected electrically in parallel with respect to the DC power source and the solenoid coil. In the present invention, in place of the current limiting resistor, the series circuit made up of the switch controller and the light-emitting diode is connected electrically in parallel with respect to the DC power source and the solenoid coil, whereby, since the electrical energy consumed originally by the current limiting resistor is used for operating the switch controller, a solenoid valve driving circuit that exhibits high energy use efficiency can be realized.

Further, preferably, the solenoid valve driving circuit further includes a resistor, which is capable of adjusting an inrush current that flows to the switch controller at a drive start time of the solenoid valve, so as to remain below a maximum value of current flowing through the solenoid coil, wherein a series circuit made up of the resistor and the switch controller, and the solenoid coil, are electrically connected in parallel with respect to the direct current power source.

Owing thereto, it becomes possible for the switch controller to be reliably protected from an inrush current, and the solenoid valve can easily be applied as well with respect to a DC power source having a relatively high power source voltage. Further, by carrying out such a countermeasure with respect to the inrush current, unintended or mistaken operations of the solenoid valve driving circuit and the solenoid valve caused by a surge voltage, which is generated momentarily inside the solenoid valve driving circuit at starting and stopping times of the solenoid valve, can reliably be prevented.

Furthermore, the same respective advantageous effects concerning the aforementioned solenoid valve driving circuits can easily be obtained in a solenoid valve as well, to which the above-mentioned various solenoid valve driving circuits have been applied.

The above and other objects, features and advantages of the present invention will become more apparent from the following descriptions when taken in conjunction with the accompanying drawings in which preferred embodiments of the present invention are shown by way of illustrative example.

DESCRIPTION OF THE PREFERRED EMBODIMENTS

Figure 1:
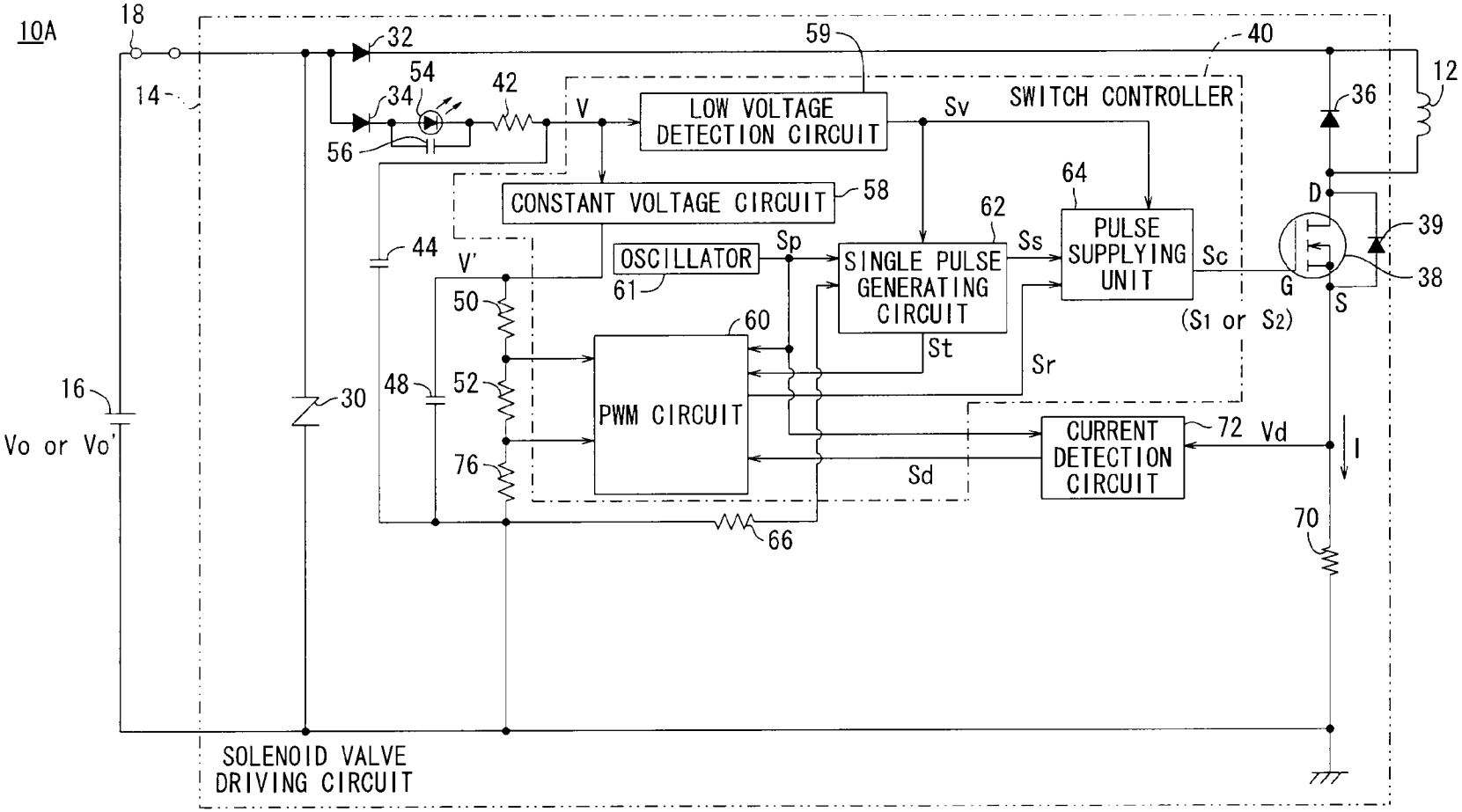
FIG. 1 is a circuit diagram for a solenoid valve according to a first embodiment.

As shown in the circuit diagram of FIG. 1, the solenoid valve 10A according to a first embodiment is equipped with a solenoid valve driving circuit 14 connected electrically with respect to a DC power source 16, and a solenoid coil 12 connected electrically with respect to the solenoid valve driving circuit 14. In this case, the positive side of the DC power source 16 is connected electrically to the solenoid coil 12 through a switch 18 and a diode 32 inside of the solenoid valve driving circuit 14, whereas the negative side of the DC power source 16 is connected to ground (earth).

The solenoid valve driving circuit 14 includes a surge absorber 30, diodes 32, 34, 36, 39, a MOSFET (metal oxide semiconductor field effect transistor) 38 serving as a switch, a switch controller 40, resistors 42, 50, 52, 66, 70, 76, condensers 44, 48, 56, a light-emitting diode (LED) 54, and a current detection circuit (current detector) 72.

In this case, the solenoid valve driving circuit 14 may be arranged internally in the solenoid valve 10A together with the solenoid coil 12, or alternatively, may be arranged externally of a non-illustrated solenoid valve main body, which accommodates the solenoid coil 12 therein. Accordingly, the solenoid valve 10A may be adopted as a structure in which the solenoid valve driving circuit 14 is connected electrically through a non-illustrated cable to the solenoid coil 12 inside of a commercially available solenoid valve, a structure in which the solenoid valve driving circuit 14 is unitized and attached externally to such a commercially available solenoid valve, or a structure in which the unitized solenoid valve driving circuit 14 is attached externally to a commercially available solenoid valve manifold.

Further, the switch controller 40 includes a constant voltage circuit 58, a low voltage detection circuit 59, a PWM circuit (short pulse generating circuit, repeating pulse generating circuit) 60, an oscillator 61, a single pulse generating circuit 62, and a pulse supplying unit 64. The switch controller 40, the MOSFET 38, the diode 39, and the current detection circuit 72, as mentioned above, can be configured, for example, as a customized IC (integrated circuit).

The surge absorber 30 is connected electrically in parallel with respect to a series circuit made up of the DC power source 16 and the switch 18. Further, a series circuit made up of the diode 34, the LED 54, the resistor 42, the switch controller 40 and the resistors 50, 52, 76, is connected electrically in parallel with respect to the surge absorber 30. Further, a series circuit made up of the diode 32, the solenoid coil 12, the MOSFET 38 and the resistor 70 is connected electrically in parallel with respect to another series circuit made up of the diode 34, the LED 54, the resistor 42, the switch controller 40 and the resistors 50, 52, 76. Still further, the condenser 56 is connected electrically in parallel with the LED 54, and the condenser 44 is connected electrically in parallel with respect to a series circuit made up of the switch controller 40 and the resistors 50, 52, 76. Further, the condenser 48 is connected electrically in parallel with respect to a series circuit made up of the resistors 50, 52, 76, the diode 36 is connected electrically in parallel with the solenoid coil 12, and the diode 39 is connected electrically between the drain terminal D and the source terminal S of the MOSFET 38.

The aforementioned surge absorber 30 acts as a circuit protective voltage-dependent resistor, for causing the surge current that flows in the solenoid valve driving circuit 14 due to the surge voltage to be rapidly channeled to ground, at activation or stoppage times (times $T_0$ and $T_1$ shown in FIGS. 2F and 3F) of the solenoid valve 10A when the switch 18 is opened and closed, as a result of the resistance value of the surge absorber 30 momentarily decreasing responsive to the surge voltage, which is momentarily generated inside the solenoid valve driving circuit 14. The surge voltage is defined as a voltage which is larger than the power source voltage $V_0$, $V_0'$ of the DC power source 16 ($V_0<V_0'$).

The diode 32 is a circuit protective diode for the purpose of preventing current from flowing in the direction of the positive electrode of the DC power source 16 through the diode 32 from the solenoid coil 12, and the diode 34 is a circuit protective diode for the purpose of preventing current from flowing in the direction of the positive electrode of the DC power source 16 through the diode 34 from the LED 54. Further, the diode 36 is a diode that refluxes (channels back) a current caused by a back electromotive force generated in the solenoid coil 12 at the stop time (time $T_1$) of the solenoid valve 10A, in a closed circuit of the solenoid coil 12 and the diode 36, for the purpose of rapidly attenuating the current. Concerning the diode 32, this diode may be replaced by a non-polarized diode bridge (not shown) if desired.

The MOSFET 38 is a semiconductor switching element, which is placed in an ON state between the drain terminal D and the source terminal S at a time when the control signal Sc (first pulse signal S1 or second pulse signal S2) is supplied to the gate terminal G from the switch controller 40, thereby electrically connecting the solenoid coil 12 on the drain terminal side D and the resistor 70 on the source terminal side S. On the other hand, the MOSFET 38 is placed in an OFF state between the drain terminal D and the source terminal S at a time when supply of the control signal Sc is halted with respect to the gate terminal G, whereby the electrical connection between the solenoid coil 12 and the resistor 70 is interrupted.

In the circuit diagram of FIG. 1, as an example of the semiconductor switching element, a case in which an N-channel depression mode MOSFET 38 is adopted is shown. However, the solenoid valve 10A according to the first embodiment is not limited to this arrangement, and any type of semiconductor switching element may be used, which is capable of rapidly switching the electrical connection between the solenoid coil 12 and the resistor 70, corresponding to whether the control signal Sc is being supplied or not. Specifically, in place of the aforementioned MOSFET 38, for example, an N-channel enhancement mode, a P-channel depression mode, or a P-channel enhancement mode MOSFET, a bipolar transistor, or a field effect transistor, may also be adopted as a matter of course.

Further, the diode 39 is a protective diode for the MOSFET 38, which serves to pass the current that flows in the direction of the solenoid coil 12 from the resistor 70.

Figures 2A, 2B, 2C, 2D, 2E, 2F:
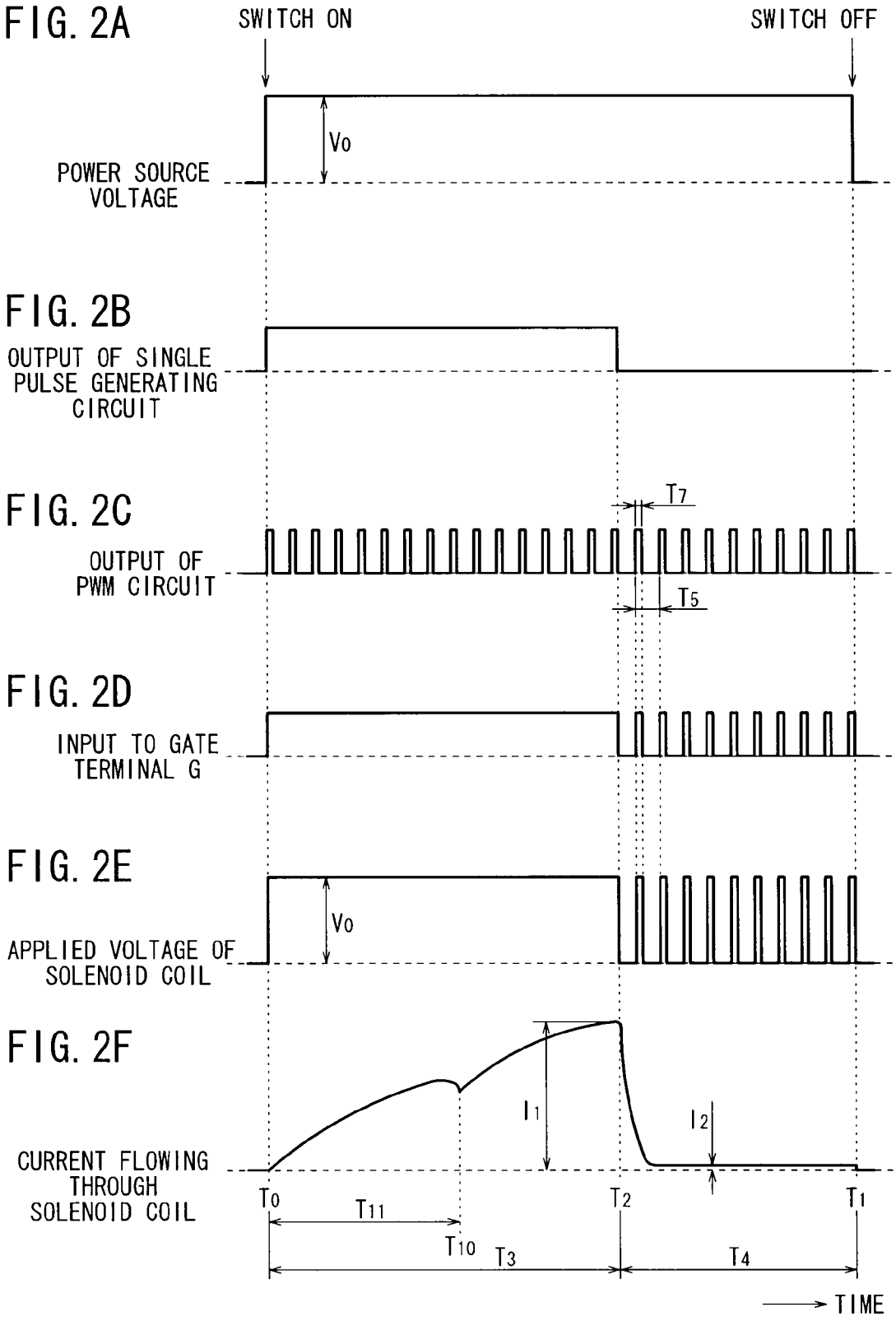
FIG. 2A is a time chart of a relatively low power source voltage in the solenoid valve of FIG. 1.
FIG. 2B is a time chart of a single pulse signal supplied to a pulse supplying unit from a single pulse generating circuit.
FIG. 2C is a time chart of a pulse signal supplied to the pulse supplying unit from a PWM circuit.
FIG. 2D is a time chart of a control signal supplied to a gate terminal of a MOSFET from the pulse supplying unit.
FIG. 2E is a time chart of a voltage impressed on a solenoid coil.
FIG. 2F is a time chart of a current that flows through the solenoid coil.
Figures 3A, 3B, 3C, 3D, 3E, 3F:
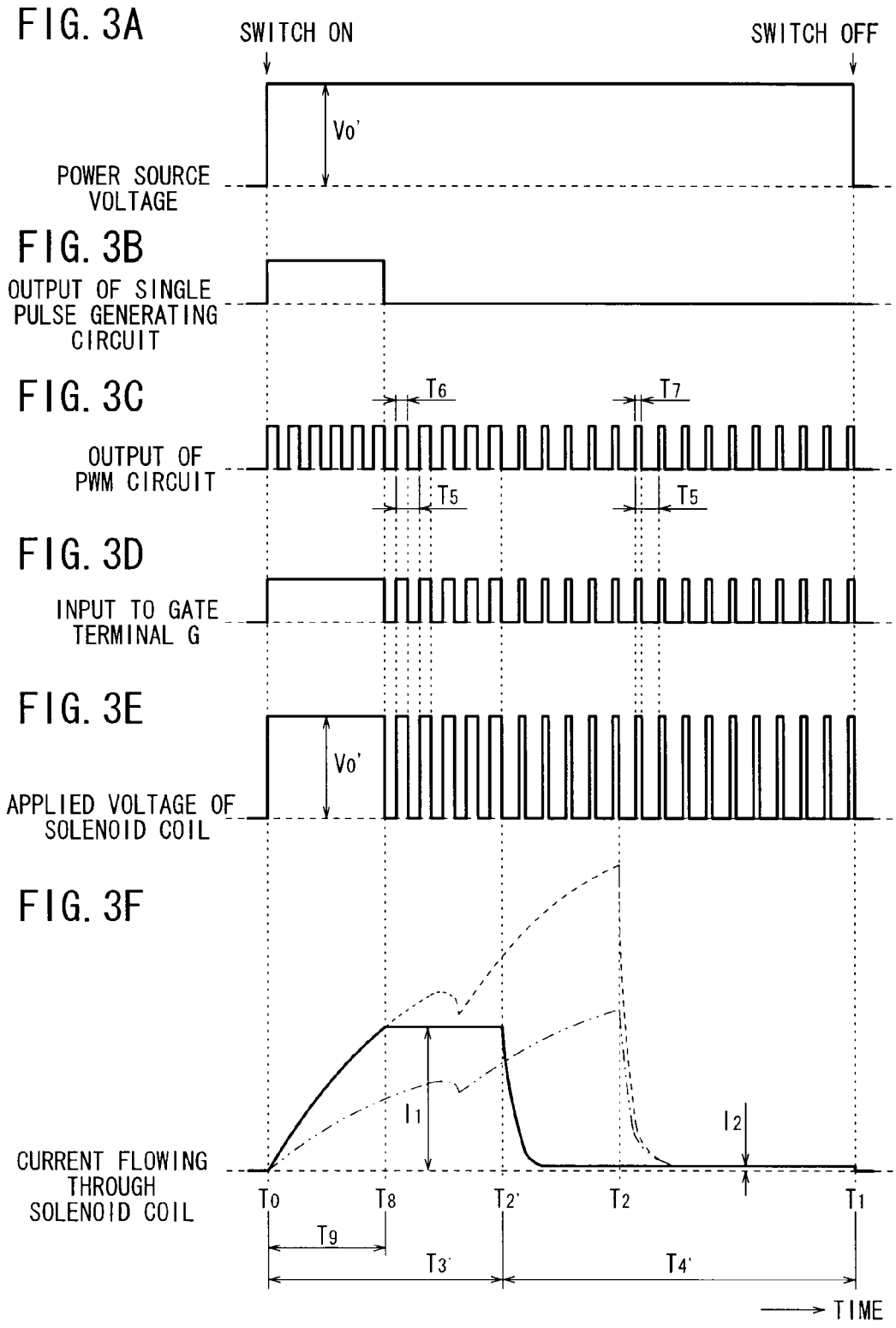
FIG. 3A is a time chart of a relatively high power source voltage in the solenoid valve of FIG. 1.
FIG. 3B is a time chart of a single pulse signal supplied to a pulse supplying unit from a single pulse generating circuit.
FIG. 3C is a time chart of a pulse signal supplied to the pulse supplying unit from a PWM circuit.
FIG. 3D is a time chart of a control signal supplied to a gate terminal of a MOSFET from the pulse supplying unit.
FIG. 3E is a time chart of a voltage impressed on a solenoid coil.
FIG. 3F is a time chart of a current that flows through the solenoid coil.

Furthermore, the aforementioned first pulse signal S1 is defined as a control signal Sc, which is supplied to the gate terminal G of the MOSFET 38 during the time period in which the solenoid valve 10A is driven (i.e., the time periods $T_3$, $T_3'$ from time $T_0$ times $T_2$, $T_2'$ in FIGS. 2F and 3F). On the other hand, the second pulse signal S2 is defined as a control signal Sc, which is supplied to the gate terminal G of the MOSFET 38 during the time period in which the driven state of the solenoid valve 10A is maintained (i.e., the time periods $T_4$, $T_4'$ from times $T_2$, $T_2'$ to time $T_1$ in FIGS. 2F and 3F).

The LED 54, during a time period when the switch 18 is in an ON state (i.e., the time period from time $T_0$ to $T_1$ shown in FIGS. 2F and 3F), due to the LED 54 becoming illuminated in response to a current flowing in the direction from the diode 34 to the resistor 42, provides a notification to the exterior that the solenoid valve 10A is in operation.

The condenser 56 is a bypass condenser for passing high frequency components included within the current that flows in the direction from the diode 34 to the resistor 42, whereas the condenser 48 is a bypass condenser for passing high frequency components included within the current that flows in the direction from the constant voltage circuit 58 to the resistors 50, 52, 76. Further, the condenser 44 is a condenser capable of adjusting the momentary interruption time of the solenoid valve driving circuit 14 including the switch controller 40 by causing a change in the capacitance thereof, as well as serving as a bypass condenser for draining to ground the high frequency components included within the current that flows in the direction of the constant voltage circuit 58 and the low voltage detection circuit 59 from the resistor 42.

The resistor 42 operates as an inrush current limiting resistor, for the purpose of suppressing an inrush current, which flows in the switch controller 40 when the switch 18 is in an ON state, so as to remain below a rated value (rated current) of the current I flowing through the solenoid coil 12. Accordingly, the resistor 42, by carrying out a countermeasure against the inrush current, functions as a resistor for preventing mistaken operations of the solenoid valve driving circuit 14 and the solenoid valve 10A, caused by the surge voltage generated in the solenoid valve driving circuit 14 at start and stop times of the solenoid valve 10A.

When the current I flows to the resistor 70 from the solenoid coil 12 through the MOSFET 38, a voltage Vd corresponding to the current I is generated at the resistor 70.

Herein, within a time period (refer to FIGS. 2F and 3F) from the time $T_0$ when the switch 18 is placed in an ON state until the time $T_1$ when the switch assumes an OFF state, a DC voltage V is impressed on the constant voltage circuit 58 from the DC power source 16 through the switch 18, the diode 34, the LED 54 and the resistor 42. The constant voltage circuit 58 converts the DC voltage V to a voltage V' having a predetermined level, and then supplies the voltage V' to the resistors 50, 52, 76. The DC voltage V represents a DC voltage, which has been reduced from the power source voltage $V_0$, $V_0'$, by respective voltage drops of the diode 34, the LED 54, and the resistor 42.

The oscillator 61 outputs a pulse signal Sp having a predetermined repeating frequency (i.e., a repeating frequency corresponding to the period of the time period $T_5$ of FIGS. 2C and 3C) to the PWM circuit 60, the single pulse generating circuit 62 and the current detection circuit 72, during a time when the DC voltage V is supplied to the switch controller 40, and more specifically, during a time period in which the aforementioned switch 18 is in an ON state.

The low voltage detection circuit 59 monitors whether or not the DC voltage V impressed on the constant voltage circuit 58 is at or below a predetermined voltage level. In the case that the DC voltage has been detected to be at or below the voltage level, a low voltage detection signal Sv indicating that the DC voltage V, which is a drive voltage for operating the switch controller 40, is a relatively low voltage, is output to the single pulse generating circuit 62 and the pulse supplying unit 64.

The single pulse generating circuit 62 generates a single pulse signal Ss having a predetermined pulse width based on the pulse signal Sp from the oscillator 61 and supplies the single pulse signal Ss to the pulse supplying unit 64. In this case, the single pulse generating circuit 62 essentially is preset to count the number of pulses of the pulse signal Sp input from the oscillator 61, and to generate a single pulse signal Ss (see FIG. 2B) having a pulse width (i.e., the pulse width of the time period $T_3$ shown in FIG. 2F) corresponding to a predetermined count number. However, it is also possible for a single pulse signal Ss (see FIG. 3B) to be generated, which has a predetermined pulse width (i.e., the pulse width of the time period $T_9$ shown in FIG. 3F) corresponding to the resistance value of the resistor 66.

That is, the single pulse generating circuit 62 is a pulse generating circuit that is capable of adjusting the pulse width of the single pulse signal Ss corresponding to the resistance value of the resistor 66. Further, the single pulse generating circuit 62 outputs a notification signal St to the PWM circuit 60, for notifying passage of the time periods $T_3$, $T_3'$.

The notification signal St is defined as a signal for notifying the PWM circuit 60 that a shift has occurred from the time period during which the solenoid valve 10A is driven (the time periods $T_3$, $T_3'$ shown in FIGS. 2F and 3F) to a time period in which the driven state is maintained (the time periods $T_4$, $T_4'$ shown in FIGS. 2F and 3F), which is output to the PWM circuit 60 from the single pulse generating circuit 62 at times $T_2$ and $T_2'$. In this case, times $T_2$, $T_2'$ are set in the single pulse generating circuit 62 corresponding to an operation of the solenoid valve 10A (first operation or second operation), which shall be described subsequently. Further, in the case that the low voltage detection signal Sv is input from the low voltage detection circuit 59, the single pulse generating circuit 62 halts generation of the single pulse signal Ss and output of the notification signal St.

The current detection circuit 72 samples the voltage Vd of the resistor 70 at the timing of the pulse signal Sp input from the oscillator 61, and the sampled voltage Vd is output as a pulse signal Sd to the PWM circuit 60. As described above, because the voltage Vd represents a voltage that corresponds to the current I flowing through the solenoid coil 12, the amplitude (voltage Vd) of the pulse signal Sd represents a voltage value (current detection value), which is indicative of the current I flowing through the solenoid coil 12.

The PWM circuit 60 generates a pulse signal Sr (first short pulse, first repeating pulse, second short pulse, or second repeating pulse) having a repeating period (i.e., the time period $T_5$ shown in FIGS. 2C and 3C) corresponding to the repeating frequency of the pulse signal Sp from the oscillator 61, and a predetermined duty ratio (i.e., the ratios $T_6/T_5$, $T_7/T_5$ of the time periods $T_6$, $T_7$ to the time period $T_5$) corresponding to the voltage value, and supplies the pulse signal Sr to the pulse supplying unit 64, based on a comparison between a voltage value corresponding to a desired current value (i.e., the first current value (activation current value) $I_1$ and the second current value (holding current value) $I_2$ shown in FIGS. 2F and 3F) with respect to the current I flowing through the solenoid coil 12 and the amplitude (voltage Vd) of the pulse signal Sd from the current detection circuit 72.

In the solenoid valve 10A, within the time periods $T_3$, $T_3'$ (refer to FIGS. 2F and 3F), an excitation force (activation force), which is caused by the current I flowing through the solenoid coil 12, is exerted on an unillustrated movable core (plunger) constituting the solenoid valve 10A, as well as on the valve plug that is installed onto an end of the plunger, thereby driving the solenoid valve 10A. On the other hand, during time periods $T_4$ and $T_4'$, another excitation force (holding force), which is caused by the current I flowing through the solenoid coil 12, is exerted on the plunger and the valve plug, so that the plunger and the valve plug are held in a predetermined position, whereby the driven state of the solenoid valve 10A is maintained.

In this case, the excitation force (activation force) required for driving the plunger and the valve plug within the time periods $T_3$, $T_3'$ which define time periods during which the solenoid valve 10A is driven, or the minimum necessary excitation force (holding force) for holding the plunger and the valve plug in a predetermined position within the time periods $T_4$, $T_4'$ which define time periods during which the solenoid valve 10A is maintained in the driven state, are values obtained by multiplying the number of windings (turns) of the solenoid coil 12 and the current I that flows through the solenoid coil 12 (respective excitation forces=number of windings×current I). Therefore, assuming that the activation force needed to drive the solenoid valve 10A, the minimum necessary holding force for maintaining the driven state, and the number of windings, respectively, are known ahead of time, an optimal current value (first current value $I_1$ as the activation current value) corresponding to the activation force, as well as an optimal current value (second current value $I_2$ as the holding current value) corresponding to the holding force, can easily be calculated.

Further, during the time periods in which the first pulse signal S1 and the second pulse signal S2 are supplied from the switch controller 40 to the gate terminal G of the MOSFET 38, because the power source voltages $V_0$, $V_0'$ are impressed on the solenoid coil 12 as the first or second voltage, and the supply of electrical power to the solenoid coil 12 from the DC power source 16 is carried out through the switch 18 and the diode 32, the current I flowing through the solenoid coil 12 increases. On the other hand, during time periods in which supply of the first pulse signal S1 and the second pulse signal S2 from the switch controller 40 to the gate terminal G of the MOSFET 38 is halted, because the supply of electrical power is halted, the current I flowing through the solenoid coil 12 is reduced.

Accordingly, by timewise controlling the supply of the first pulse signal S1 and the second pulse signal S2 with respect to the gate terminal G, the current I flowing through the solenoid coil 12 can be maintained at the desired current value (the first current value $I_1$ and the second current value $I_2$).

Consequently, in the solenoid valve driving circuit 14, the voltage Vd corresponding to the current I flowing through the solenoid coil 12 is output from the resistor 70 to the current detection circuit 72, and a pulse signal Sd having the amplitude of the voltage Vd indicated by the current detection value is fed back to the PWM circuit 60 of the switch controller 40 from the current detection circuit 72.

In the PWM circuit 60, based on a comparison between the voltage value corresponding to the current value (first current value $I_1$) optimal for the activation force and the amplitude (voltage Vd) of the fed back pulse signal Sd, a pulse signal Sr (first repeating pulse or first short pulse) is generated having a repeating period of time $T_5$ and a duty ratio of $T_6/T_5$. On the other hand, based on a comparison between the voltage value corresponding to the current value (second current value $I_2$) optimal for the holding force and the amplitude of the fed back pulse signal Sd, a pulse signal Sr (second repeating pulse or second short pulse) is generated having a repeating period of time $T_5$ and a duty ratio of $T_7/T_5$.

As stated above, the duty ratios $T_6/T_5$ and $T_7/T_5$ represent duty ratios corresponding to optimal current values (i.e., the first current value $I_1$ and the second current value $I_2$), and such duty ratios are set based on the resistance values of the resistors 50, 52, 76. More specifically, the duty ratio $T_6/T_5$ is a duty ratio corresponding to a predetermined voltage, which is generated by dividing the DC voltage V' supplied from the constant voltage circuit 58 by each of the resistance values of the resistors 52, 76, whereas the duty ratio $T_7/T_5$ is a duty ratio corresponding to a predetermined voltage, which is generated by dividing the DC voltage V' supplied from the constant voltage circuit 58 by each of the resistance values of the resistors 50, 52, 76. Accordingly, in the PWM circuit 60, the duty ratios $T_6/T_5$ and $T_7/T_5$ of the pulse signal Sr are adjustable by appropriately changing the resistance values of the resistors 50, 52, 76 corresponding to the sizes of the first current value $I_1$ and the second current value $I_2$.

In this case, in the PWM circuit 60, the second repeating pulse or the second short pulse having the duty ratio of $T_7/T_5$ is generated as the pulse signal Sr (see FIG. 2C). Alternatively, until the notification signal St is received from the single pulse generating circuit 62, the first repeating pulse or the first short pulse having the duty ratio of $T_6/T_5$ is generated as the pulse signal Sr, whereas, after the notification signal St is received, the second repeating pulse or the second short pulse is generated as the pulse signal Sr (see FIG. 3C).

The first repeating pulse and the first short pulse are pulses having a pulse width (time period $T_6$) shorter than the pulse width of the single pulse signal Ss (see FIG. 3C). That is, the first repeating pulse is a pulse having a pulse width of the time period $T_6$, which is generated to repeat at a period of time $T_5$, whereas the first short pulse is a pulse having a pulse width of the time period $T_6$.

Further, the second repeating pulse and the second short pulse are pulses having a pulse width (time period $T_7$) shorter than the pulse widths of the first repeating pulse and the first short pulse (see FIGS. 2C and 3C). That is, the second repeating pulse is a pulse having a pulse width of the time period $T_7$, which is generated to repeat at a period of time $T_5$, whereas the second short pulse is a pulse having a pulse width of the time period $T_7$.

The pulse supplying unit 64 is constructed to include an OR circuit, for example, and serves to supply, as a control signal Sc, the single pulse signal Ss from the single pulse generating circuit 62, or alternatively the pulse signal Sr from the PWM circuit 60, to the gate terminal G of the MOSFET 38. More specifically, the pulse supplying unit 64, at the aforementioned time periods $T_3$, $T_3'$, supplies the single pulse signal Ss or the pulse signal Sr (the first repeating pulse or the first short pulse) as the first pulse signal S1 to the gate terminal G, whereas, at time periods $T_4$, $T_4'$, supplies the pulse signal Sr made up of the second repeating pulse or the second short pulse signal as the second pulse signal S2 to the gate terminal G. Further, in the case that the low voltage detection signal Sv is input from the low voltage detection circuit 59, the pulse supplying unit 64 suspends supply of the first pulse signal S1 or the second pulse signal S2 to the gate terminal G.

The solenoid valve 10A according to the first embodiment is constructed basically as described above. Now, with reference to FIG. 1 through FIG. 3F, operations of the solenoid valve 10A shall be explained.

(1) An operation of the solenoid valve 10A in the case that the first pulse signal S1 having the pulse width of time period $T_3$ and the second pulse signal S2 (second repeating pulse) having a duty ratio of $T_7/T_5$ are supplied from the switch controller 40 to the gate terminal G of the MOSFET 38 (hereinafter, first operation), and (2) an operation of the solenoid valve 10A in the case that the single pulse signal Ss having a pulse width of time period $T_9$ and the pulse signal Sr (first repeating pulse) having a duty ratio of $T_6/T_5$ are supplied as a first pulse signal S1 from the switch controller 40 to the gate terminal G, and thereafter, a pulse signal Sr (second repeating pulse) having a duty ratio of $T_7/T_5$ is supplied as a second pulse signal S2 from the switch controller 40 to the gate terminal G (hereinafter, second operation), shall be described below with reference to the circuit diagram of FIG. 1 and the time charts of FIGS. 2A through 3F.

Explanations shall be given assuming that, during the first operation, the power source voltage of the DC power source is set at $V_0$, whereas during the second operation, the power source voltage of the DC power source is set at $V_0'$. More specifically, the first operation is an operation of the solenoid valve 10A for a case in which, at the side of the user of the solenoid valve 10A, a DC power source 16 having a relatively low power source voltage (e.g., $V_0$=12V) is prepared. On the other hand, the second operation is an operation of the solenoid valve 10A for a case in which, at the side of the user of the solenoid valve 10A, a DC power source 16 having a relatively high power source voltage (e.g., $V_0'$=24V) is prepared. Further, explanations shall be made, assuming that, during the first operation and the second operation, the amplitude of the single pulse Ss supplied to the pulse supplying unit 64 from the single pulse generating circuit 62 and the amplitude of the pulse signal Sr supplied to the pulse supplying unit 64 from the PWM circuit 60 are substantially at the same level.

First, explanations concerning the first operation shall be given with reference to the circuit diagram of FIG. 1 and the time charts of FIGS. 2A through 2F.

At time $T_0$, when the switch 18 is closed and the device is placed in an ON state (see FIG. 2A), a DC voltage V is applied by the constant voltage circuit 58, which is reduced from the voltage $V_0$ of the DC power source 16 by voltage drops across each of the diode 34, the LED 54 and the resistor 42. At this time, the LED 54 emits light in response to current flowing in the direction of the resistor 42 from the diode 34, thereby notifying externally of the solenoid valve 10A that the solenoid valve 10A is under operation.

The constant voltage circuit 58 converts the DC voltage V to a predetermined DC voltage V', and supplies the DC voltage V' to a series circuit made up of the resistors 50, 52, 76. Further, the low voltage detection circuit 59 monitors whether or not the DC voltage V is at or below a predetermined voltage level. The oscillator 61 generates a pulse signal Sp having a frequency that is repeated at a period corresponding to the period of the time $T_5$, and supplies the pulse signal Sp to the PWM circuit 60, the single pulse generating circuit 62 and the current detection circuit 72.

Based on the supply of the pulse signal Sp, the single pulse generating circuit 62 generates a single pulse signal Ss having a pulse width of the time period $T_3$ (see FIG. 2B) and outputs the generated single pulse signal Ss to the pulse supplying unit 64.

The current detection circuit 72 carries out sampling, at the timing of the pulse signal Sp, with respect to the voltage Vd that corresponds to the current I in the resistor 70, and the sampled voltage Vd is output as a pulse signal Sd to the PWM circuit 60.

The PWM circuit 60, based on a comparison between the voltage corresponding to the second current value $I_2$ and the amplitude (voltage Vd) of the pulse signal Sd, generates a pulse signal Sr of the second repeating pulse, having a duty ratio of $T_7/T_5$ corresponding to the respective resistances of the resistors 50, 52, 76, and further having a repeating period of the time period $T_5$, and supplies the pulse signal Sr to the pulse supplying unit 64 (see FIG. 2C).

Within the time period $T_3$ from time $T_0$ time $T_2$, a single pulse signal Ss from the single pulse generating circuit 62 is input to the pulse supplying unit 64, and together therewith, the pulse signal Sr is input from the PWM circuit 60. However, as described previously, because the pulse supplying unit 64 is constructed with an OR circuit therein, and since the respective amplitudes of the single pulse signal Ss and the pulse signal Sr are substantially the same amplitude, the pulse supplying unit 64 supplies the single pulse signal Ss as the first pulse signal S1 to the gate terminal G of the MOSFET 38 (see FIG. 2D).

Owing thereto, based on the first pulse signal S1 supplied to the base terminal G, an ON state is formed between the drain terminal D and the source terminal S, whereby the MOSFET 38 is connected electrically to the solenoid coil 12 and the resistor 70. Therefore, the power source voltage $V_0$ is applied to the solenoid coil 12 as the first voltage from the DC power source 16 and through the switch 18 and the diode 32 (see FIG. 2E). On the other hand, the current I that flows in the direction of the resistor 70 from the solenoid coil 12 through the MOSFET 38 rapidly increases with the passage of time (see FIG. 2F). As a result, the plunger and valve plug are energized quickly by the excitation force (activation force)

caused by the current I, and the solenoid valve 10A shifts from a closed state into an open state.

Further, at time $T_{10}$, the current I, which has increased rapidly over time, decreases slightly (see FIG. 2F). This is caused by the plunger being attracted to a non-illustrated fixed iron core, in accordance with the activation force.

Next, at time $T_2$, when the current I flowing through the solenoid coil 12 reaches the predetermined first current $I_1$, the single pulse generating circuit 62 stops generating the single pulse signal Ss, and supply thereof to the pulse supplying unit 64 is suspended (see FIG. 2B). In addition, a notification signal St is output to the PWM circuit 60 notifying that the time period $T_3$ has passed (i.e., that the single pulse signal Ss has been terminated).

On the other hand, the PWM circuit 60, also during the time period $T_4$ from time $T_2$ to time $T_1$, by the same circuit operation noted previously at the time period $T_3$, generates the second repeating pulse as the pulse signal Sr, and supplies the same to the pulse supplying unit 64 (see FIG. 2C). In this case, because only the pulse signal Sr is input to the pulse supplying unit 64 from the PWM circuit 60, the pulse supplying unit 64 supplies the pulse signal Sr as the second pulse signal S2 to the gate terminal G of the MOSFET 38 (see FIG. 2D).

Owing thereto, based on the second pulse signal S2 supplied to the gate terminal G, an ON state is formed between the drain terminal D and the source terminal S, whereby the MOSFET 38 is connected electrically to the solenoid coil 12 and the resistor 70. Therefore, the power source voltage $V_0$ is applied to the solenoid coil 12 as the second voltage from the DC power source 16 and through the switch 18 and the diode 32 (see FIG. 2E). On the other hand, the current I that flows in the direction of the resistor 70 from the solenoid coil 12 through the MOSFET 38, decreases rapidly, in a short time period from time $T_2$, from the first current $I_1$ to a predetermined second current $I_2$, and thereafter, the second current $I_2$ is maintained during the time period until time $T_1$ (see FIG. 2F). As a result, the plunger and valve plug are held at a predetermined position by the excitation force (holding force) caused by the second current $I_2$, whereby the driven state (valve open state) of the solenoid valve 10A is maintained.

In addition, at time $T_1$, when the switch 18 is opened and the device is placed in an OFF state (see FIG. 2A), since the supply of the DC voltage V to the switch controller 40 is suspended, the low voltage detection circuit 59 outputs a low voltage detection signal Sv to the single pulse generating circuit 62 and to the pulse supplying unit 64, whereby, based on input of the low voltage detection signal Sv thereto, the pulse supplying unit 64 stops supplying the second pulse signal S2 to the gate terminal G of the MOSFET 38. Owing thereto, because the MOSFET 38 is rapidly switched from an ON state to an OFF state between the drain terminal D and the source terminal S thereof, a condition is reached in which application of the voltage $V_0$ to the solenoid coil 12 from the DC power source 16 is halted. In this case, although a back electromotive force is generated in the solenoid coil 12, a current caused by the back electromotive force is refluxed (i.e., flows backward) inside of a closed circuit made up of the solenoid coil 12 and the diode 36, so that the current is quickly attenuated.

Next, explanations concerning the second operation shall be given with reference to the circuit diagram of FIG. 1 and the time charts of FIGS. 3A through 3F.

At time $T_0$, when the switch 18 is closed and the device is placed in an ON state (see FIG. 3A), a DC voltage V is applied by the constant voltage circuit 58, which is reduced from the voltage $V_0'$ of the DC power source 16 by voltage drops across each of the diode 34, the LED 54 and the resistor 42. At this time, the LED 54 emits light in response to the current flowing in the direction of the resistor 42 from the diode 34, thereby notifying externally of the solenoid valve 10A that the solenoid valve 10A is under operation.

The constant voltage circuit 58 converts the DC voltage V to a predetermined DC voltage V', and supplies the DC voltage V' to a series circuit made up of the resistors 50, 52, 76. Further, the low voltage detection circuit 59 monitors whether or not the DC voltage V is at or below a predetermined voltage level. The oscillator 61 generates a pulse signal Sp having a frequency that is repeated at a period corresponding to the period of the time $T_5$, and supplies the pulse signal Sp to the PWM circuit 60, the single pulse generating circuit 62, and the current detection circuit 72.

Based on supply of the pulse signal Sp and the resistance value of the resistor 66, the single pulse generating circuit 62 generates and outputs to the pulse supplying unit 64 a single pulse signal Ss having a pulse width of the time period $T_9$ (see FIG. 3B).

The current detection circuit 72 carries out sampling, at the timing of the pulse signal Sp, with respect to the voltage Vd that corresponds to the current I in the resistor 70, and the sampled voltage Vd is output as a pulse signal Sd to the PWM circuit 60.

Based on a comparison between a voltage value corresponding to the first current value $I_1$ and the amplitude (voltage Vd) of the pulse signal Sd, during a time period $T_3'$ until the time $T_2'$ at which the notification signal St from the single pulse generating circuit 62 is input, the PWM circuit 60 generates a pulse signal Sr of the first repeating pulse, having a duty ratio of $T_6/T_5$ corresponding to the respective resistances of the resistors 50 and 52, and further having a repeating period of the time period $T_5$, and supplies the pulse signal Sr to the pulse supplying unit 64 (see FIG. 3C).

Within the time period $T_9$ from time $T_0$ time $T_8$, a single pulse signal Ss from the single pulse generating circuit 62 is input to the pulse supplying unit 64, and together therewith, the pulse signal Sr is input from the PWM circuit 60. However, as described previously, because the pulse supplying unit 64 is constructed with an OR circuit therein, and since the respective amplitudes of the single pulse signal Ss and the pulse signal Sr are substantially the same amplitude, the pulse supplying unit 64 supplies the single pulse Ss as the first pulse signal S1 to the gate terminal G of the MOSFET 38 (see FIG. 3D).

Owing thereto, based on the first pulse signal S1 supplied to the gate terminal G, an ON state is formed between the drain terminal D and the source terminal S, whereby the MOSFET 38 connects electrically the solenoid coil 12 and the resistor 70. Therefore, the power source voltage $V_0'$ is applied to the solenoid coil 12 as the first voltage from the DC power source 16 and through the switch 18 and the diode 32 (see FIG. 3E). On the other hand, the current I that flows in the direction of the resistor 70 from the solenoid coil 12 through the MOSFET 38 rapidly increases over time within the time period $T_9$ until reaching the first current value $I_1$ (see FIG. 3F), and the plunger and valve plug are energized quickly by the excitation force (activation force) caused by the current I, whereby the solenoid valve 10A shifts from a closed state into an open state.

Subsequently, at time $T_8$, just after elapse of the time period $T_9$, the single pulse generating circuit 62 stops generating the single pulse Ss and supply thereof to the pulse supplying unit 64 is suspended (see FIG. 3B).

On the other hand, the PWM circuit 60, also during the time period from time $T_8$ to time $T_2'$, by the same circuit operations noted previously at the time period $T_9$, generates the first repeating pulse as the pulse signal Sr, and supplies the same to the pulse supplying unit 64 (see FIG. 3C). In this case, because only the pulse signal Sr is input to the pulse supplying unit 64 from the PWM circuit 60, the pulse supplying unit 64 supplies the pulse signal Sr as the first pulse signal S1 to the gate terminal G of the MOSFET 38 (see FIG. 3D).

Owing thereto, based on the first pulse signal S1 supplied to the gate terminal G, an ON state is formed between the drain terminal D and the source terminal S, whereby the MOSFET 38 connects electrically the solenoid coil 12 and the resistor 70. Therefore, the power source voltage $V_0'$ is applied to the solenoid coil 12 as a first voltage from the DC power source 16 and through the switch 18 and the diode 32 (see FIG. 3E). On the other hand, the current I that flows in the direction of the resistor 70 from the solenoid coil 12 through the MOSFET 38 is maintained at the first current $I_1$ during the time period from time $T_8$ until time $T_2'$ (see FIG. 3F).

In FIG. 3F, the waveform shown by the dashed line represents a situation in which feedback control of the current I is not carried out by the solenoid valve driving circuit 14, and shows a timewise change of the current I in the case that application of the power source voltage $V_0'$ continues until time $T_2$. On the other hand, the two-dot-dashed line waveform shows a timewise change of the current I during the time period $T_3$ (i.e., the time period from time $T_0$ to time $T_2$) of FIG. 2F (i.e., a timewise change of the current I at the relatively low power source voltage $V_0$).

Herein, an integration over time of the current I flowing through the solenoid coil 12, that is, the partial area (current I×time) surrounded by the time waveform of the current I, the current values at two times, and the zero level (i.e., the dashed line extending in the horizontal direction in FIGS. 2F and 3F), indicates the amount of energy that is supplied to the solenoid coil 12 from the DC power source 16. Accordingly, the energy amounts (current I×time periods $T_3$, $T_3'$) supplied to the solenoid coil 12 from the DC power source 16 during the time periods $T_3$ and $T_3'$ from time $T_0$ times $T_2$ and $T_2'$ represents the energy amounts required to drive the solenoid valve 10A.

Because the same solenoid valve 10A is used for both of the above-noted first operation and second operation, the energy amount required to drive the solenoid valve 10A is the same, irrespective of differences in operation. As a result, the timewise integration of the current I during the first operation (the area of the current I×the time period $T_3$) is the same as the timewise integration of the current I during the second operation (the area of the current I×the time period $T_3'$).

Accordingly, assuming that the timewise integrations of the current I (the area of the current I×the time periods $T_3$, $T_3'$) during the first operation and the second operation are adjusted identically, during the second operation (the solid line in FIG. 3F), the current I flowing through the solenoid coil 12 rises to the current level $I_1$ over a shorter time period than in the first operation (the two-dot-dashed line in FIG. 3F). Additionally, by supplying the energy amount from the DC power source 16 to the solenoid coil 12 within the time period $T_3'$, which is shorter than the time period $T_3$ (refer to FIG. 2F), the solenoid valve 10A can be driven in a short time.

Next, at time $T_2'$, the single pulse generating circuit 62 (see FIG. 1) outputs a notification signal St to the PWM circuit 60, for notifying passage of the time period $T_3'$. Accordingly, based on the notification signal St, during the time period $T_4'$ from time $T_2'$ to time $T_1$, in place of the aforementioned pulse signal Sr having the duty ratio of $T_6/T_5$, the PWM circuit 60 generates a pulse signal Sr of the second repeating pulse, having a duty ratio of $T_7/T_5$, based on the respective resistances of the resistors 50 and 52, and further, having a repeating period of the time period $T_5$, and supplies the pulse signal Sr to the pulse supplying unit 64 (see FIG. 3C). In this case, because only the pulse signal Sr is input to the pulse supplying unit 64 from the PWM circuit 60, the pulse supplying unit 64 supplies the pulse signal Sr as the second pulse signal S2 to the gate terminal G of the MOSFET 38 (see FIG. 3D).

Owing thereto, based on the second pulse signal S2 supplied to the gate terminal G, an ON state is formed between the drain terminal D and the source terminal S, whereby the MOSFET 38 connects electrically the solenoid coil 12 and the resistor 70. Therefore, the power source voltage $V_0'$ is applied to the solenoid coil 12 as a second voltage from the DC power source 16 and through the switch 18 and the diode 32 (see FIG. 3E). On the other hand, concerning the current I that flows in the direction of the resistor 70 from the solenoid coil 12, after being reduced rapidly in a short time period from time $T_2'$, from the first current value $I_1$ to the second current value $I_2$, the current I is maintained at the second current value $I_2$ during the time period until time $T_1$ is reached (see FIG. 3F). As a result, the plunger and valve plug are held at a predetermined position by the excitation force (holding force) caused by the second current $I_2$, whereby the driven state (valve open state) of the solenoid valve 10A is maintained.

In addition, at time $T_1$, when the switch 18 is opened and the device is placed in an OFF state (see FIG. 3A), since the supply of the DC voltage V to the switch controller 40 is suspended, the low voltage detection circuit 59 outputs a low voltage detection signal Sv to the single pulse generating circuit 62 and to the pulse supplying unit 64, whereby, based on input of the low voltage detection signal Sv thereto, the pulse supplying unit 64 stops supplying the second pulse signal S2 to the gate terminal G of the MOSFET 38. Owing thereto, because the MOSFET 38 is rapidly switched from an ON state to an OFF state between the drain terminal D and the source terminal S thereof, a condition is reached in which application of the voltage $V_0'$ to the solenoid coil 12 from the DC power source 16 is halted. In this case, although a back electromotive force is generated by the solenoid coil 12, a current caused by the back electromotive force refluxes (i.e., flows backward) inside of a closed circuit made up of the solenoid coil 12 and the diode 36, so that the current is quickly attenuated.

In this manner, in the solenoid valve 10A according to the first embodiment, a voltage Vd corresponding to the current I flowing through the solenoid coil 12 is output from the resistor 70 to the current detection circuit 72, and in the current detection circuit 72, a pulse signal Sd having an amplitude of the voltage Vd serving as a current detection value is fed back to the PWM circuit 60 of the switch controller 40.

In the PWM circuit 60, based on a comparison between the voltage value corresponding to the current value of either the first current value $I_1$ (activation current value) or the second current value $I_2$ (holding current value) and the amplitude (voltage Vd) of the fed back pulse signal Sd, a pulse signal Sr (first repeating pulse, first short pulse, second repeating pulse, or second short pulse) is generated having a pulse width of the time period $T_5$ and a predetermined duty ratio of $T_6/T_5$ or $T_7/T_5$, and the pulse signal Sr is supplied to the pulse supplying unit 64.

The pulse supplying unit 64 supplies the single pulse signal Ss from the single pulse generating circuit 62 as the first pulse signal S1 to the gate terminal G of the MOSFET 38, and thereafter, supplies the pulse signal Sr from the PWM circuit 60 as the second pulse signal S2 to the gate terminal G of the MOSFET 38. Alternatively, the pulse supplying unit 64 supplies the single pulse signal Ss and the pulse signal Sr as the first pulse signal S1 to the gate terminal G of the MOSFET 38, and thereafter, supplies the pulse signal Sr as the second pulse signal S2 to the gate terminal G of the MOSFET 38.

More specifically, in the time period (time period $T_3$, $T_3'$) during which the solenoid valve 10A is driven, the PWM circuit 60 of the switch controller 40 generates the pulse signal Sr, made up of the first repeating pulse or the first short pulse, and supplies the same to the pulse supplying unit 64, so that the current detection value corresponding to the amplitude (voltage Vd) of the pulse signal Sd becomes the first current value $I_1$ corresponding to the activation force of the solenoid valve 10A, and the pulse supplying unit 64 supplies the pulse signal Sr as the first pulse signal S to the gate terminal G of the MOSFET 38. Owing thereto, the MOSFET 38 controls the application time of the first voltage (power source voltage $V_0$, $V_0'$) to the solenoid coil 12 based on the pulse width of the first pulse signal S1. As a result, the current I that flows through the solenoid coil 12 is maintained at the first current value $I_1$ corresponding to the activation force, while the activation force caused by the current I (first current value $I_1$) is applied for energizing the plunger and the valve plug.

In greater detail, for a case in which, at the side of the user of the solenoid valve 10A, a DC power source 16 having a relatively high power source voltage $V_0'$ (e.g., $V_0'$=24V) is prepared beforehand, whereas with respect to such a DC power source 16, a solenoid valve 10A is applied that is intended for use with a relatively low power source voltage $V_0$ (e.g. $V_0$=12V), in such a case, in the PWM circuit 60 of the switch controller 40, the first current value $I_1$ is set to be at or below a rated value (rated current) of the current I that flows through the solenoid coil 12. Assuming the pulse width (time period $T_6$) of the pulse signal Sr is adjusted such that the current detection value becomes the thus set first current value $I_1$, then since the current I flowing through the solenoid coil 12 during the time period (time period $T_3$, $T_3'$) in which the solenoid valve 10A is driven is maintained at the first current value $I_1$, even on the side of a user who has prepared the DC power source 16 having the relatively high power source voltage $V_0'$, electric power savings of the solenoid valve 10A and the solenoid valve driving circuit 14 can be achieved. In this case, because the relatively high power source voltage $V_0'$ is applied as the first voltage to the solenoid coil 12, the solenoid valve 10A can be driven in a shorter time.

As described above, since, by adjusting the pulse width (time period $T_6$) of the pulse signal Sr in the PWM circuit 60 of the switch controller 40, the current I flowing through the solenoid coil 12 can be maintained at the first current value $I_1$ at or below the rated current, on the side of the manufacturer, without concern to differences in the power source voltages $V_0$, $V_0'$ supplied to the solenoid coil 12 from the DC power source 16 prepared on the side of the user, the solenoid valve 10A and the solenoid valve driving circuit 14 can be made commonly usable in conformity with a relatively low power source voltage, and by providing such a commonly usable solenoid valve 10A and solenoid valve driving circuit 14 to the user, costs can be reduced.

Accordingly, with the solenoid valve 10A according to the first embodiment, by generating the pulse signal Sr of the first repeating pulse or the first short pulse based on a comparison between the pulse signal Sd having the voltage Vd corresponding to the current detection value that is fed back to the switch controller 40 from the current detection circuit 72 and the voltage value corresponding to the first current value $I_1$ during a time period (time period $T_3$, $T_3'$) in which the solenoid valve 10A is driven, power savings of the solenoid valve 10A and the solenoid valve driving circuit 14, common usage and cost reduction, and a rapidly-responsive drive control for the solenoid valve 10A, are all capable of being realized.

On the other hand, during a time period (time period $T_4$, $T_4'$) in which the driven state of the solenoid valve 10A is maintained, the PWM circuit 60 of the switch controller 40 generates a pulse signal Sr of the second repeating pulse or the second short pulse, so that the current detection value corresponding to the amplitude (voltage Vd) of the pulse signal Sd becomes the second current value $I_2$ corresponding to the holding force for the solenoid valve 10A, whereupon the pulse signal Sr is supplied to the pulse supplying unit 64, and the pulse supplying unit 64 supplies the pulse signal Sr as the second pulse signal S2 to the gate terminal G of the MOSFET 38. Owing thereto, the MOSFET 38 controls the application time during which the second voltage (power source voltage $V_0$, $V_0'$) is applied to the solenoid coil 12, based on the pulse width of the second pulse signal S2. As a result, the current I flowing through the solenoid coil 12 is maintained at the second current value $I_2$ corresponding to the holding force, and the holding force induced by the current I (second current value $I_2$) is applied to energize the plunger and the valve plug.

Accordingly, with the solenoid valve 10A according to the first embodiment, by generating the pulse signal Sr of the second repeating pulse or the second short pulse based on a comparison between the pulse signal Sd having the voltage Vd corresponding to the current detection value that is fed back to the switch controller 40 from the current detection circuit 72 and the voltage value corresponding to the second current value $I_2$ during a time period (time period $T_4$, $T_4'$) in which the driven state of the solenoid valve 10A is maintained, the driven state of the solenoid valve 10A can be maintained with smaller power consumption, and further, the solenoid valve 10A can be stopped in a short time.

Further, by feeding back the pulse signal Sd having the voltage Vd corresponding to the current detection value to the PWM circuit 60 of the switch controller 40, even if the current I tends to vary over time due to changes of the electrical resistance inside the solenoid coil 12 or changes in the power source voltage $V_0$, $V_0'$ as a result of temperature changes in the solenoid coil 12, the pulse signal Sr is generated responsive to such changes, whereby the solenoid valve 10A and the solenoid valve driving circuit 14, which are capable of responding to changes in the use environment, such as changes in electrical resistance and power source voltage $V_0$, $V_0'$ or the like, can be realized.

In this manner, with the solenoid valve 10A according to the first embodiment, a reduction in electrical power consumption of the solenoid valve 10A and the solenoid valve driving circuit 14, rapidly responsive drive control for the solenoid valve 10A, and a reduction in costs for the solenoid valve 10A and the solenoid valve driving circuit 14, can all be realized together in one sweep.

Further, at the time period (time period $T_3$, $T_3'$) during which the solenoid valve 10A is driven, after the power source voltage $V_0'$ has been impressed as the first voltage on the solenoid coil 12 only at a time period $T_9$ corresponding to the pulse width of the single pulse Ss, the first voltage is impressed on the solenoid coil 12 only at the time period corresponding to the pulse width (time period $T_6$) of the pulse signal Sr of the first repeating pulse or the first short pulse. As a result, within the time period during which the solenoid valve 10A is driven, after the current I flowing through the solenoid coil 12 has risen up to the first current value $I_1$ within the time period $T_9$ corresponding to the pulse width of the single pulse signal Ss, the first current value $I_1$ is maintained by a switching operation of the MOSFET 38 based on the first repeating pulse or the first short pulse. Owing thereto, the solenoid valve 10A and the solenoid valve driving circuit 14 can be made commonly usable, and costs can be reduced easily. In particular, in the case that a DC power source 16, for which the power source voltage $V_0'$ thereof is relatively high, is electrically connected to the solenoid coil 12 through the solenoid valve driving circuit 14 and the solenoid valve 10A is driven thereby, the solenoid valve 10A is capable of being driven in a shorter time. Furthermore, by maintaining the current I flowing through the solenoid coil 12 at the first current value $I_1$, unintended or mistaken operations of the solenoid valve 10A and the solenoid valve driving circuit 14 caused by the input of excessive voltage (surge energy) thereto can be reliably prevented.

On the other hand, during a time period (time period $T_4$, $T_4'$) at which the driven state of the solenoid valve 10A is maintained, by supplying the pulse signal Sr of the second repeating pulse or the second short pulse as the second pulse signal S2 to the MOSFET 38, the driven state of the solenoid valve 10A can be maintained with lower power consumption, and further, the solenoid valve 10A can be stopped in a short time.

Accordingly, by providing a structure, including the PWM circuit 60, the single pulse generating circuit 62 and the pulse supplying unit 64, for the switch controller 40, common usage and cost reduction of the solenoid valve 10A and the solenoid valve driving circuit 14, driving of the solenoid valve 10A in a short time, power savings of the solenoid valve 10A and the solenoid valve driving circuit 14, and the ability to stop the solenoid valve 10A in a short time, can easily be realized.

Further, in the solenoid valve driving circuit 14, a series circuit made up of the diode 34, the LED 54, the resistor 42, the switch controller 40 and the resistors 50, 52, 76, and a series circuit made up of the diode 32, the solenoid coil 12, the MOSFET 38 and the resistor 70, are electrically connected in parallel with respect to a series circuit made up of the DC power source 16 and the switch 18. Although, conventionally, a series circuit made up of the LED 54 and a current limiting resistor for causing light to be emitted from the LED 54 have been connected electrically in parallel with respect to the DC power source 16 and the solenoid coil 12, in the present invention, in place of the current limiting resistor, the series circuit including the switch controller 40 and the LED 54 is connected electrically in parallel with respect to the DC power source 16 and the solenoid coil 12, whereby, since the electrical energy consumed originally by the current limiting resistor is utilized for operating the switch controller 40, a solenoid valve driving circuit 14 exhibiting high energy use efficiency can be realized.

Further, owing to the arrangement of the resistor 42, it becomes possible for the switch controller 40 to be reliably protected from an inrush current, and in addition, the solenoid valve 10A can easily be applied as well with respect to a DC power source 16 having a relatively high power source voltage $V_0'$. Further, by carrying out such a countermeasure with respect to the inrush current, unintended or mistaken operations of the solenoid valve 10A and the solenoid valve driving circuit 14 caused by a surge voltage, which is generated momentarily inside the solenoid valve driving circuit 14 at starting and stopping times of the solenoid valve 10A, can reliably be prevented.

Further, in the PWM circuit 60, the duty ratios $T_6/T_5$ and $T_7/T_5$ of the pulse signal Sr are adjustable by changing the resistance values of the resistors 50, 52, 76, whereas in the single pulse generating circuit 62, the pulse width of the single pulse signal Ss is adjustable by changing the resistance value of the resistor 66. Owing thereto, irrespective of changes in the power source voltage $V_0$, $V_0'$, the switch controller 40 and the MOSFET 38 can be operated stably, and the voltage range (i.e., the range of the power source voltage $V_0$, $V_0'$) usable with the solenoid valve driving circuit 14 is capable of being widely set.

Concerning adjustment of the duty ratios $T_6/T_5$ and $T_7/T_5$ and the pulse width of the single pulse signal Ss, instead of the aforementioned resistors 50, 52, 66, 76, a non-illustrated memory may be used to store the duty ratios $T_6/T_5$ and $T_7/T_5$ and the pulse width of the single pulse signal Ss, and then, as necessary, the duty ratios $T_6/T_5$ and $T_7/T_5$ and the pulse width may be read out from the memory to the PWM circuit 60 and the single pulse generating circuit 62. Accordingly, by changing the data stored in the memory, the duty ratios $T_6/T_5$ and $T_7/T_5$ and the pulse width can be set appropriately to desired values, corresponding to the specifications of the solenoid valve 10A.

In the above explanations of the solenoid valve 10A according to the first embodiment, within the time period at which the solenoid valve 10A is driven, supply of the first pulse signal S1 is timewise controlled based on a comparison between the voltage value that corresponds to the first current value $I_1$ and the amplitude (the voltage Vd corresponding to the current detection value) of the pulse signal Sd. On the other hand, within the time period at which the driven state of the solenoid valve 10A is maintained, supply of the second pulse signal S2 is timewise controlled based on a comparison between the current value that corresponds to the second current value $I_2$ and the amplitude of the pulse signal Sd.

In the solenoid valve 10A according to the first embodiment, it is a matter of course that such a timewise control based on the current detection value can be carried out solely during a time period in which the solenoid valve 10A is driven, or alternatively, during a time period in which the driven state of the solenoid valve 10A is maintained.

More specifically, in order to carry out the timewise control based on the current detection value only during the time period in which the solenoid valve 10A is driven, in the time period (time period $T_3'$) when the solenoid valve 10A is driven, the solenoid valve 10A is driven based on the aforementioned second operation, whereas, in the time period (time period $T_4'$) when the driven state of the solenoid valve 10A is maintained, the PWM circuit 60 generates either a predetermined second repeating pulse having a duty ratio of $T_7/T_5$ and a repeating period of the time period $T_5$, or a predetermined second short pulse having a pulse width of the time period $T_7$, and outputs such pulses to the pulse supplying unit 64.

Even in this case, during the time period in which the solenoid valve 10A is driven, the above-mentioned effects of the timewise control based on the current detection value can easily be obtained.

On the other hand, only during the time period in which the driven state of the solenoid valve 10A is maintained, in order to carry out the timewise control based on the current detection value, the aforementioned first operation is performed. Even in this case, during the time period in which the driven state of the solenoid valve 10A is maintained, the above-mentioned effects of the timewise control based on the current detection value can easily be obtained.

Further, in the solenoid valve 10A according to the first embodiment, although the solenoid valve driving circuit 14 is constructed to include an LED 54 therein, even if the LED 54 is omitted, the aforementioned effects can still be obtained as a matter of course.

Figure 4:
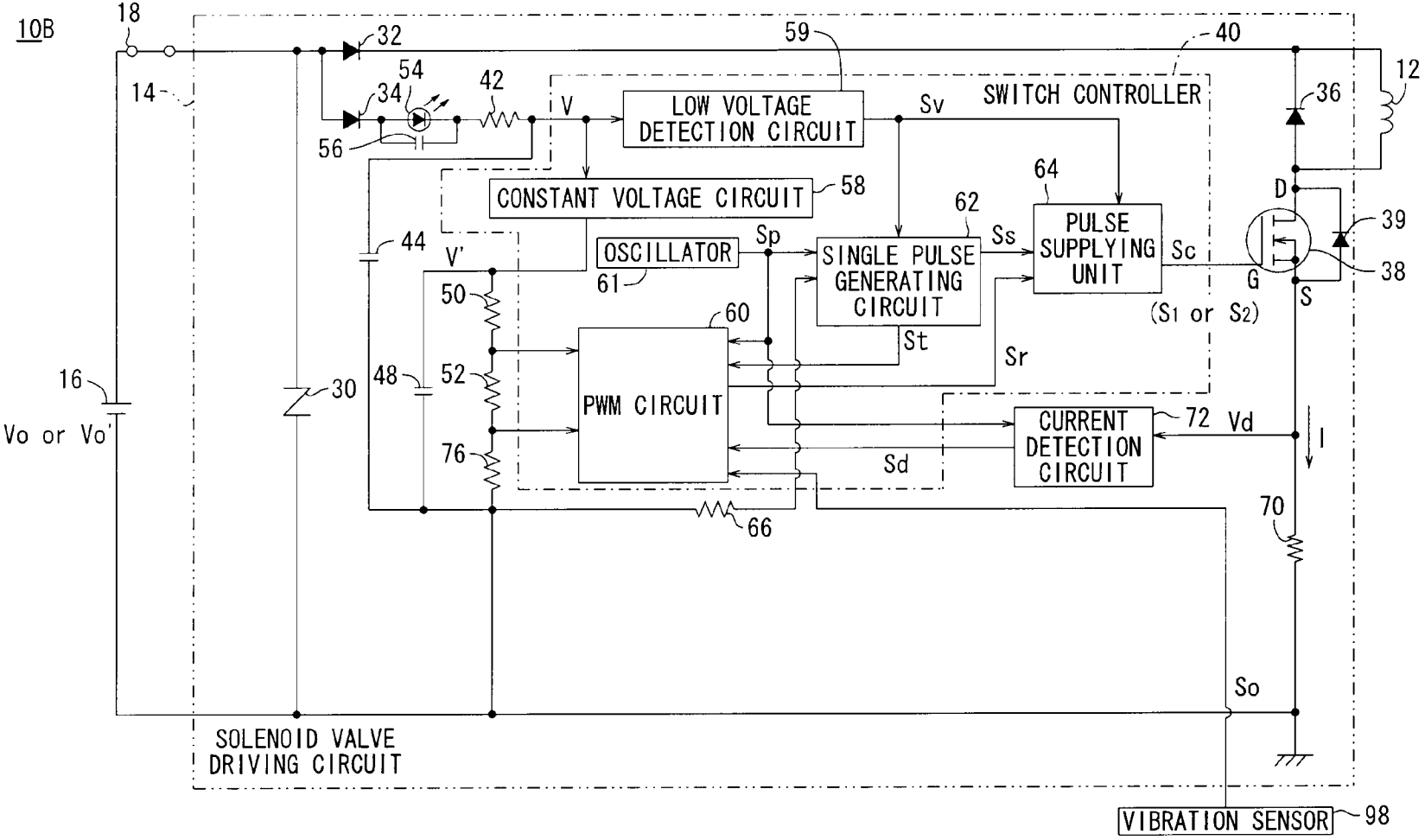
FIG. 4 is a circuit diagram for a solenoid valve according to a second embodiment.

Next, with reference to FIG. 4, explanations shall be given concerning a solenoid valve 10B in accordance with a second embodiment of the present invention. In the following descriptions, constituent elements, which are the same as those in the solenoid valve 10A (see FIGS. 1 to 3F) are designated by the same reference numerals, and detailed explanations of such features shall be omitted.

The solenoid valve 10B according to the second embodiment differs from the solenoid valve 10A according to the first embodiment, in that it includes a vibration sensor 98.

The vibration sensor 98 detects vibrations generated inside the solenoid valve 10B as a result of vibrations and/or shocks imparted to the solenoid valve 10B from the exterior. Detection results are output as a vibration detection signal So (vibration detection value) to the PWM circuit 60 of the switch controller 40. Based on the vibration detection signal So from the vibration sensor 98, the PWM circuit 60 increases the duty ratio $T_7/T_5$ (i.e., the pulse width of the time period $T_7$) of the pulse signal Sr that is supplied to the pulse supplying unit 64 during the time period $T_4$, $T_4'$ (refer to FIGS. 2F and 3F). Owing thereto, even if there are concerns that the current I (second current value $I_2$) flowing through the solenoid coil 12 might change over time due to vibrations inside the solenoid valve 10B, causing stoppage of the solenoid valve 10B during the time period (time period $T_4$, $T_4'$) in which the driven state of the solenoid valve 10B is maintained, by increasing the duty ratio $T_7/T_5$, the current I can be raised.

When the holding force is reduced in order to conserve power, it may be envisaged that vibrations inside the solenoid valve 10B could be caused which might lead to stoppage of the solenoid valve 10B. However, according to the solenoid valve 10B of the second embodiment, by providing the switch controller 40 with the above-noted structure, even if the current I (second current value $I_2$) flowing through the solenoid coil 12 changes over time due to vibrations inside the solenoid valve 10B, by adjusting the pulse width of the pulse signal Sr (second pulse signal S2) corresponding to such changes, a solenoid valve 10B and solenoid valve driving circuit 14, which are capable of responding to such vibration-induced changes, can be realized.

That is, during the time period (time period $T_4$, $T_4'$) in which the driven state of the solenoid valve 10B is maintained, in the event it is feared that the solenoid valve 10B may reach a stopped state due to vibrations, the pulse width (time period $T_7$) of the pulse signal Sr (second pulse signal S2) is lengthened and the current I (second current value $I_2$) flowing through the solenoid coil 12 is increased, whereby the holding force on the plunger and the valve plug inside the solenoid valve 10B is made to increase, so that the solenoid valve 10B can be prevented from coming into a stopped state.

Accordingly, in the solenoid valve 10B according to the second embodiment, because the pulse width of the second pulse signal S2 can be set longer so that the level of the current I becomes greater only in those cases when a high holding force is necessary, power savings of the solenoid valve 10B and the solenoid valve driving circuit 14 can be carried out efficiently.

In existing solenoid valves, although it is known to detect valve-open and valve-closed states of the solenoid valve by detection of the pressure inside the solenoid valve utilizing an internal pressure sensor, wherein restarting of the solenoid valve is carried out based on such a detection result, by applying the features of the above-described solenoid valve 10B to the existing solenoid valve, stoppage of the solenoid valve during a time period (time period $T_4$) in which the driven state of the existing solenoid valve is maintained can reliably be prevented.

Figure 5:
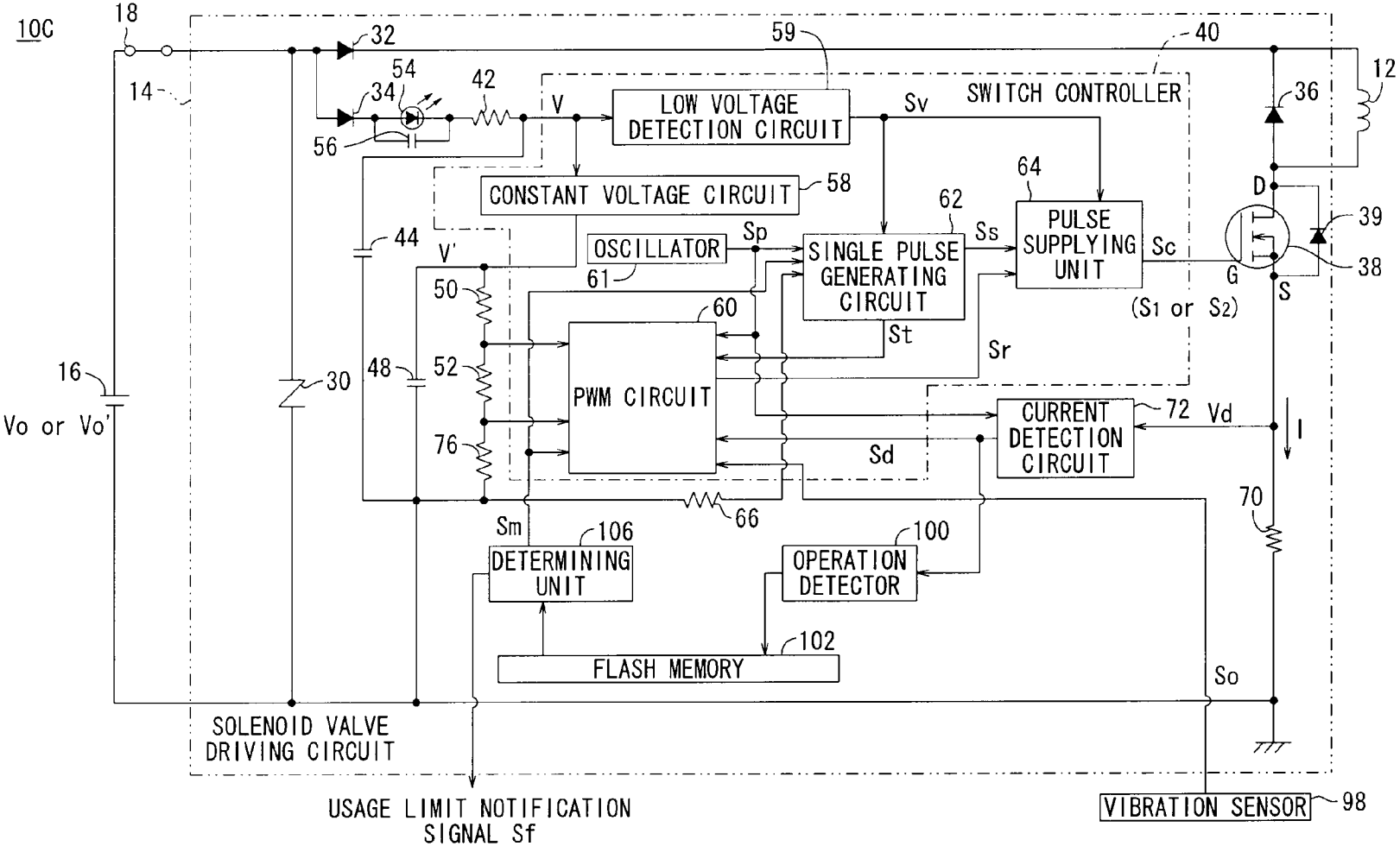
FIG. 5 is a circuit diagram for a solenoid valve according to a third embodiment.

Next, with reference to FIG. 5, explanations shall be given concerning a solenoid valve 10C in accordance with a third embodiment of the present invention.

The solenoid valve 10C according to the third embodiment differs from the solenoid valve 10B according to the second embodiment (see FIG. 4), in that the solenoid valve driving circuit 14 further includes an operation detector (energization time calculator and solenoid valve operation detector) 100, a flash memory (energization time memory and detection result memory) 102, and a determining unit (energization time determining unit and accumulated number of operation times determining unit) 106.

The operation detector 100 includes a counter, which calculates the energization time of the solenoid coil 12 (total time during which the power source voltage $V_0$, $V_0'$ is impressed on the solenoid coil 12) in one operational period (the time period from time $T_0$ time $T_1$ in FIGS. 2F and 3F) of the solenoid valve 10C based on the pulse signal Sd, and the detection result is stored in the flash memory 102. Alternatively, the operation detector 100 detects that the solenoid valve 10C is in operation based on the pulse signal Sd, and stores the detection result thereof in the flash memory 102.

The determining unit 106 calculates the total energization time of the solenoid coil 12 based on the totality of the energization time that has been stored in the flash memory 102 after the end of each operation of the solenoid valve 10C, and determines whether or not the total energization time is longer than a predetermined first energization time. Alternatively, the determining unit 106 calculates an accumulated number of operation times of the solenoid valve 10C from each of respective detection results stored in the flash memory 102, and determines whether or not the accumulated number of operation times exceeds a predetermined first number of operation times.

In this case, when the determining unit 106 determines that the total energization time is longer than the predetermined first energization time, or alternatively, that the accumulated number of operation times has exceeded the predetermined first number of operation times, the determining unit 106 outputs a pulse width change signal Sm to the single pulse generating circuit 62 and the PWM circuit 60 of the switch controller 40, instructing that the pulse width (time period $T_3$, $T_9$) of the single pulse signal Ss and the pulse width (time period $T_6$) of the pulse signal Sr should be changed. Based on the pulse width change signal Sm, the single pulse generating circuit 62 sets the pulse width of the single pulse signal Ss to be longer than the currently set pulse width. On the other hand, based on the pulse width change signal Sm, the PWM circuit 60 sets the pulse width of the pulse signal Sr to be longer than the currently set pulse width.

Further, when the determining unit 106 determines that the total energization time has become longer than a predetermined second energization time, which is set to be longer than the predetermined first energization time, or alternatively, when the determining unit 106 determines that the accumulated number of operation times exceeds a predetermined second number of operation times, which is set to be greater than the first predetermined number of operation times, the determining unit 106 externally outputs a usage limit notification signal Sf, notifying that the solenoid valve 10C has reached a usage limit.

In this manner, by means of the solenoid valve 10C according to the third embodiment, even in cases where the driving performance of the solenoid valve 10C is decreased through use of the solenoid valve over a prolonged period, by setting the pulse widths of each of the single pulse signal Ss and the pulse signal Sr to be longer at times when the total energization time of the solenoid valve 10C becomes longer than the first energization time, or when the accumulated number of operation times exceeds the first number of operation times, the current I (first current value $I_1$) flowing through the solenoid coil 12 becomes larger, and the activation force can be increased. Thus, driving control of the solenoid valve 10C can be carried out efficiently.

Further, because the determining unit 106 outputs the usage limit notification signal Sf to the exterior when the total energization time of the solenoid valve 10C becomes longer than the second energization time, or when the accumulated number of operation times exceeds the second number of operation times, it becomes possible to quickly exchange the solenoid valve 10C whenever the usage limit thereof is reached, so that reliability with respect to the usage limit (life) of the solenoid valve 10C is improved.

Figure 6:
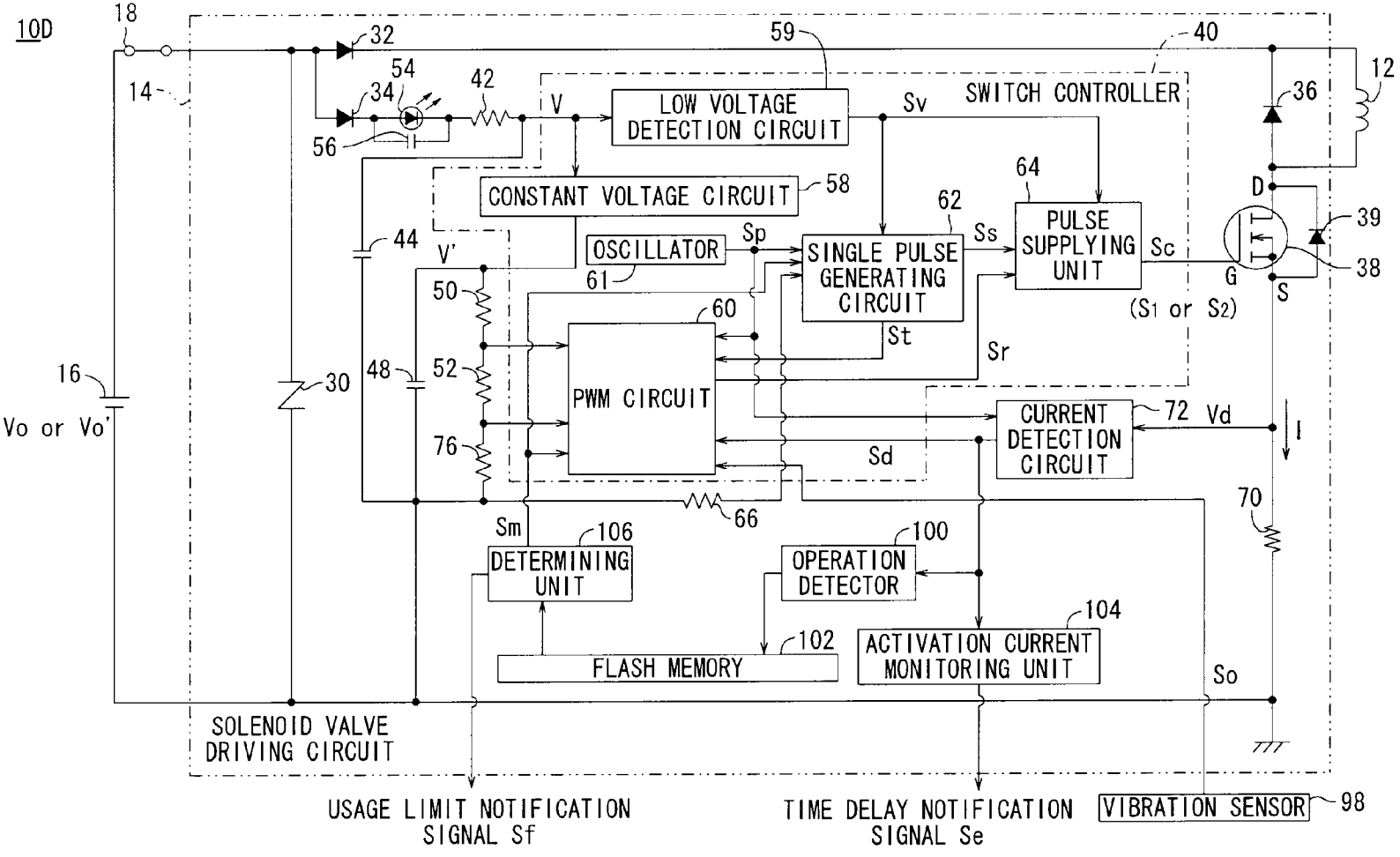
FIG. 6 is a circuit diagram for a solenoid valve according to a fourth embodiment.

Next, with reference to FIG. 6, explanations shall be given concerning a solenoid valve 10D in accordance with a fourth embodiment of the present invention.

The solenoid valve 10D according to the fourth embodiment differs from the solenoid valve 10C according to the third embodiment (see FIG. 5), in that the solenoid valve driving circuit 14 further includes an activation current monitoring unit (current detection value monitoring unit) 104.

The current detection value monitoring unit 104 monitors a time period $T_{11}$, from time $T_0$ time $T_{10}$, at which the current I (and the voltage Vd corresponding thereto) slightly decreases during a time period (time period $T_3$, $T_3'$) at which the solenoid valve 10D is driven. When it is determined that the time period $T_{11}$ has become longer than a predetermined set time, a time delay notification signal Se is output to the exterior, for notifying that a time delay was generated in the time period $T_{11}$.

In this manner, by means of the solenoid valve 10D according to the fourth embodiment, it becomes possible to quickly exchange the solenoid valve 10D for which the time period $T_{11}$ has become long, and thus the driving performance thereof has degraded. That is, by providing the solenoid valve driving circuit 14 having the aforementioned structure, detection of the usage limit (life) of the solenoid valve 10D can be carried out efficiently, based on the responsiveness of the solenoid valve 10D during the time period at which the solenoid valve is driven.

The solenoid valve driving circuit and solenoid valve according to the present invention are not limited to the aforementioned embodiments. Various other structures and configurations may be adopted as a matter of course without deviating from the essence and gist of the present invention.

What is claimed is:

1. A solenoid valve driving circuit in which, after a first voltage is impressed on a solenoid coil of a solenoid valve for driving said solenoid valve, a second voltage is impressed on said solenoid coil and a driven state of said solenoid valve is maintained, the solenoid valve driving circuit being electrically connected, respectively, to a direct current power source and to said solenoid coil, and further comprising a switch controller, a switch, and a current detector, wherein said current detector detects a current flowing through said solenoid coil, and outputs a detection result, as a current detection value, to said switch controller, wherein said switch controller generates a first pulse signal based on a comparison between a predetermined activation current value and said current detection value, and a second pulse signal based on a comparison between a predetermined holding current value and said current detection value, and supplies said first pulse signal and said second pulse signal to said switch, and wherein said switch applies a power source voltage of said direct current power source as said first voltage to said solenoid coil during a time period when said first pulse signal is supplied thereto, and applies said power source voltage as said second voltage to said solenoid coil during a time period when said second pulse signal is supplied thereto.

2. The solenoid valve driving circuit according to claim 1, wherein said switch controller comprises:

a single pulse generating circuit for generating a single pulse;

a short pulse generating circuit, which, during a time period in which said solenoid valve is driven, generates a first short pulse having a pulse width shorter than a pulse width of said single pulse based on a comparison between said activation current value and said current detection value, whilst, during a time period in which a driven state of said solenoid valve is maintained, generates a second short pulse having a pulse width shorter than said pulse width of said first short pulse based on a comparison between said holding current value and said current detection value; and a pulse supplying unit, which, during the time period in which said solenoid valve is driven, supplies said first short pulse to said switch as said first pulse signal after said single pulse has been supplied to said switch as said first pulse signal, whilst, during the time period in which the driven state of said solenoid valve is maintained, supplies said second short pulse to said switch as said second pulse signal.

3. The solenoid valve driving circuit according to claim 1, wherein said switch controller comprises:

a single pulse generating circuit for generating a single pulse;

a repeating pulse generating circuit, which, during a time period in which said solenoid valve is driven, generates a first repeating pulse having a pulse width shorter than a pulse width of said single pulse based on a comparison between said activation current value and said current detection value, whilst, during a time period in which a driven state of said solenoid valve is maintained, generates a second repeating pulse having a pulse width shorter than said pulse width of said first repeating pulse based on a comparison between said holding current value and said current detection value; and a pulse supplying unit, which, during the time period in which said solenoid valve is driven, supplies said first repeating pulse to said switch as said first pulse signal after said single pulse has been supplied to said switch as said first pulse signal, whilst, during the time period in which the driven state of said solenoid valve is maintained, supplies said second repeating pulse to said switch as said second pulse signal.

4. A solenoid valve driving circuit in which, after a first voltage is impressed on a solenoid coil of a solenoid valve for driving said solenoid valve, a second voltage is impressed on said solenoid coil and a driven state of said solenoid valve is maintained, the solenoid valve driving circuit being electrically connected, respectively, to a direct current power source and to said solenoid coil, and further comprising a switch controller, a switch, and a current detector, wherein said current detector detects a current flowing through said solenoid coil, and outputs a detection result, as a current detection value, to said switch controller, wherein said switch controller generates a first pulse signal based on a comparison between a predetermined activation current value and said current detection value, and a predetermined second pulse signal, and supplies said first pulse signal and said second pulse signal to said switch, and wherein said switch applies a power source voltage of said direct current power source as said first voltage to said solenoid coil during a time period when said first pulse signal is supplied thereto, and applies said power source voltage as said second voltage to said solenoid coil during a time period when said second pulse signal is supplied thereto.

5. The solenoid valve driving circuit according to claim 4, wherein said switch controller comprises:

a single pulse generating circuit for generating a single pulse;

a short pulse generating circuit, which, during a time period in which said solenoid valve is driven, generates a first short pulse having a pulse width shorter than a pulse width of said single pulse based on a comparison between said activation current value and said current detection value, whilst, during a time period in which a driven state of said solenoid valve is maintained, generates a predetermined second short pulse having a pulse width shorter than said pulse width of said first short pulse; and a pulse supplying unit, which, during the time period in which said solenoid valve is driven, supplies said first short pulse to said switch as said first pulse signal after said single pulse has been supplied to said switch as said first pulse signal, whilst, during the time period in which the driven state of said solenoid valve is maintained, supplies said second short pulse to said switch as said second pulse signal.

6. The solenoid valve driving circuit according to claim 4, wherein said switch controller comprises:

a single pulse generating circuit for generating a single pulse;

a repeating pulse generating circuit, which, during a time period in which said solenoid valve is driven, generates a first repeating pulse having a pulse width shorter than a pulse width of said single pulse based on a comparison between said activation current value and said current detection value, whilst, during a time period in which a driven state of said solenoid valve is maintained, generates a predetermined second repeating pulse having a pulse width shorter than said pulse width of said first repeating pulse; and a pulse supplying unit, which, during the time period in which said solenoid valve is driven, supplies said first repeating pulse to said switch as said first pulse signal after said single pulse has been supplied to said switch as said first pulse signal, whilst, during the time period in which the driven state of said solenoid valve is maintained, supplies said second repeating pulse to said switch as said second pulse signal.

7. A solenoid valve driving circuit in which, after a first voltage is impressed on a solenoid coil of a solenoid valve for driving said solenoid valve, a second voltage is impressed on said solenoid coil and a driven state of said solenoid valve is maintained, the solenoid valve driving circuit being electrically connected, respectively, to a direct current power source and to said solenoid coil, and further comprising a switch controller, a switch, and a current detector, wherein said current detector detects a current flowing through said solenoid coil, and outputs a detection result, as a current detection value, to said switch controller, wherein said switch controller generates a predetermined first pulse signal, and a second pulse signal based on a comparison between a predetermined holding current value and said current detection value, and supplies said first pulse signal and said second pulse signal to said switch, and wherein said switch applies a power source voltage of said direct current power source as said first voltage to said solenoid coil during a time period when said first pulse signal is supplied thereto, and applies said power source voltage as said second voltage to said solenoid coil during a time period when said second pulse signal is supplied thereto.

8. The solenoid valve driving circuit according to claim 7, wherein said switch controller comprises:

a single pulse generating circuit for generating a single pulse;

a short pulse generating circuit, which generates a short pulse having a pulse width shorter than a pulse width of said single pulse based on a comparison between said holding current value and said current detection value; and a pulse supplying unit, which, during the time period in which said solenoid valve is driven, supplies said single pulse to said switch as said first pulse signal, whilst, during the time period in which the driven state of said solenoid valve is maintained, supplies said short pulse to said switch as said second pulse signal.

9. The solenoid valve driving circuit according to claim 7, wherein said switch controller comprises:

a single pulse generating circuit for generating a single pulse;

a repeating pulse generating circuit, which generates a repeating pulse having a pulse width shorter than a pulse width of said single pulse based on a comparison between said holding current value and said current detection value; and a pulse supplying unit, which, during the time period in which said solenoid valve is driven, supplies said single pulse to said switch as said first pulse signal, whilst, during the time period in which the driven state of said solenoid valve is maintained, supplies said repeating pulse to said switch as said second pulse signal.

10. The solenoid valve driving circuit according to claim 1, wherein said switch controller adjusts the pulse width of said second pulse signal based on a vibration detection value from a vibration detector, which detects vibration of said solenoid valve.

11. The solenoid valve driving circuit according to claim 1, further comprising:

an energization time calculator for calculating an energization time of said solenoid coil inside of a one-time operating period of said solenoid valve based on said current detection value;

an energization time memory for storing said energization time; and an energization time determining unit for calculating a total energization time of said solenoid coil from each of respective energization times stored in said energization time memory, and determining whether or not said total energization time is longer than a predetermined first energization time, wherein said energization time determining unit outputs a pulse width change signal to said switch controller instructing that the pulse width of said first pulse signal be changed, when it is determined that said total energization time is longer than said first energization time, and wherein said switch controller lengthens the pulse width of said first pulse signal based on said pulse width change signal.

12. The solenoid valve driving circuit according to claim 11, wherein said energization time determining unit externally outputs a usage limit notification signal notifying that said solenoid valve has reached a usage limit, when it is determined that said total energization time is longer than a second energization time, which is set to be longer than said first energization time.

13. The solenoid valve driving circuit according to claim 1, further comprising:

a solenoid valve operation detector for detecting that said solenoid valve is under operation based on said current detection value;

a detection result memory for storing a detection result of said solenoid valve operation detector; and an accumulated number of operation times determining unit for calculating an accumulated number of operation times of said solenoid valve from each of respective detection results stored in said detection result memory, and determining whether or not said accumulated number of operation times exceeds a predetermined first number of operation times, wherein said accumulated number of operation times determining unit outputs a pulse width change signal to said switch controller instructing that the pulse width of said first pulse signal be changed, when it is determined that said accumulated number of operation times exceeds said first number of operation times, and wherein said switch controller lengthens the pulse width of said first pulse signal based on said pulse width change signal.

14. The solenoid valve driving circuit according to claim 13, wherein said accumulated number of operation times determining unit externally outputs a usage limit notification signal notifying that said solenoid valve has reached a usage limit, when it is determined that said accumulated number of operation times exceeds a second number of operation times, which is set to be greater than said first number of operation times.

15. The solenoid valve driving circuit according to claim 1, further comprising:

a current detection value monitoring unit for monitoring a decrease in said current detection value during a time period in which said solenoid valve is driven, wherein said current detection value monitoring unit externally outputs a time delay notification signal for notifying that a time delay was generated in a time period from a drive start time of said solenoid valve to a time at which said current detection value decreases, when it is determined that said time period is longer than a predetermined set time period.

16. The solenoid valve driving circuit according to claim 1, further comprising:

a light-emitting diode capable of emitting light when said current flows through said solenoid coil, wherein a series circuit made up of said light-emitting diode and said switch controller, and said solenoid coil, are electrically connected in parallel with respect to said direct current power source.

17. The solenoid valve driving circuit according to claim 1, further comprising:

a resistor capable of adjusting an inrush current that flows to said switch controller at a drive start time of said solenoid valve, so as to be below a maximum value of current flowing through said solenoid coil, wherein a series circuit made up of said resistor and said switch controller, and said solenoid coil, are electrically connected in parallel with respect to said direct current power source.

18. A solenoid valve having the solenoid valve driving circuit as set forth in claim 1.

* * * * *